US008915671B2

(12) United States Patent
Weaver

(10) Patent No.: US 8,915,671 B2
(45) Date of Patent: Dec. 23, 2014

(54) SYSTEM AND METHOD OF FORMING A ROADWAY COMPRISING POLYURETHANE

(71) Applicant: Sean Somers Weaver, Redding, CA (US)

(72) Inventor: Sean Somers Weaver, Redding, CA (US)

(73) Assignee: Technisoil Industrial LLC, Redding, CA (US)

( * ) Notice: Subject to any disclaimer, the term of this patent is extended or adjusted under 35 U.S.C. 154(b) by 45 days.

(21) Appl. No.: 13/772,307

(22) Filed: Feb. 20, 2013

(65) Prior Publication Data

US 2013/0216307 A1 Aug. 22, 2013

Related U.S. Application Data

(60) Provisional application No. 61/601,018, filed on Feb. 20, 2012, provisional application No. 61/619,430, filed on Apr. 3, 2012, provisional application No. 61/700,338, filed on Sep. 13, 2012.

(51) Int. Cl.
*E01C 7/30* (2006.01)
*E01C 23/06* (2006.01)

(52) U.S. Cl.
CPC ..... *E01C 23/065* (2013.01)
USPC ..... 404/75

(58) Field of Classification Search
USPC ..... 404/75, 90, 91, 92
See application file for complete search history.

(56) References Cited

U.S. PATENT DOCUMENTS

| | | | | |
|---|---|---|---|---|
| 5,971,657 | A * | 10/1999 | Medico et al. | 404/92 |
| 6,102,613 | A * | 8/2000 | Medico et al. | 404/17 |
| 7,767,259 | B2 * | 8/2010 | Fox | 427/212 |
| 8,038,364 | B2 * | 10/2011 | Newton et al. | 404/17 |
| 8,137,024 | B2 * | 3/2012 | Kaul | 404/31 |
| 8,814,464 | B2 * | 8/2014 | McDade et al. | 404/75 |
| 8,821,064 | B1 * | 9/2014 | Morris et al. | 404/75 |
| 2013/0195551 | A1 * | 8/2013 | McDade et al. | 404/75 |
| 2013/0216308 | A1 * | 8/2013 | Weaver | 404/75 |

* cited by examiner

*Primary Examiner* — Gary Hartmann
(74) *Attorney, Agent, or Firm* — Kwan & Olynick LLP

(57) ABSTRACT

A method of forming a roadway is provided comprising providing a reclaimer-stabilizer machine, providing in-situ soil materials, forming a base layer using the reclaimer-stabilizer machine, forming a wear layer over the base layer, and wherein the wear layer comprises a polyurethane composition in addition to the in-situ materials. In some embodiments the roadway is comprised of a single layer comprising a polyurethane material. In other embodiments a method of forming a roadway comprising cured asphalt composite is provided.

25 Claims, 4 Drawing Sheets

SYSTEM AND METHOD OF FORMING A ROADWAY COMPRISING POLYURETHANE

RELATED APPLICATIONS

This application claims the benefit of priority to commonly-owned U.S. Provisional Patent Applications No. 61/601,018, filed on Feb. 20, 2012, No. 61/619,430, filed on Apr. 3, 2012, and No. 61/700,338, filed on Sep. 13, 2012. All of the above-identified patent applications are herein incorporated by reference.

FIELD OF THE INVENTION

The present invention relates generally to the field of road building, and more specifically to a system and method of forming a roadway using reclaimer-stabilizer machines in combination with polyurethane based materials.

BACKGROUND OF THE INVENTION

Roadways made of concrete, asphalt, and compacted soil are subject to extreme stresses from thermal cycling, vehicular traffic, and UV exposure which eventually lead to defects in the roadway such as cracks and potholes. Concrete roadways require large amounts of heavy raw materials to be transported to the road building site, which is prohibitively expensive for roads placed in remote locations for access to mines, oil and gas pipelines, logging sites and the like. Asphalt may be used for applications that require a high level of durability, but the cost of transporting the heavy raw materials needed for this system is prohibitively expensive for many applications.

Reclaimer-stabilizer machines are typically used to prepare new surface materials from existing road beds by pulverizing the road bed material and compacting the remaining soil. These machines may include rotating cutting assemblies, scrapers, augers and other systems designed to pulverize, reclaim, compact, and otherwise stabilize untreated in-situ soil materials or an existing roadbed. Within the context of this disclosure, "in-situ soil materials" refer to any pre-existing earthen materials such as sand, dust, clay, rock, and other earthen materials that are pre-existing at the site of road formation and which have not been transported thereto.

SUMMARY OF THE INVENTION

Provided herein is a roadway comprising a base layer of compacted in-situ material and wear layer layer disposed on the base layer wherein the wear layer comprises a liquid-applied polyurethane material. In some embodiments the base layer comprises a liquid-applied polyurethane material.

Further provided herein is a method of forming a stabilized roadway, the method comprising pulverizing in-situ soil using a reclaimer-stabilizer machine, spraying a liquid polyurethane composition into the pulverized soil, and compacting the combined mixture to form a roadway. In some embodiments the liquid polyurethane is supplied from a pug mill attached directly to the reclaimer-stabilizer machine. In other embodiments the pug mill is provided in proximity to the reclaimer-stabilizer machine and connected in order to supply liquid polyurethane to the dispensing portions of the reclaimer-stabilizer machine.

Also provided herein is a method of forming a roadway, the method comprising providing an existing asphalt or concrete roadway, pulverizing the asphalt or concrete surface into rubble, mixing the rubble with a polyurethane mixture to form a slurry, pressing the slurry onto a foundation layer of soil and allowing the slurry to cure, wherein the polyurethane mixture comprises a liquid polyurethane and a heat stabilizer.

These and other embodiments are described further below with reference to the figures.

DESCRIPTION OF THE PREFERRED EMBODIMENTS

Figure 1:
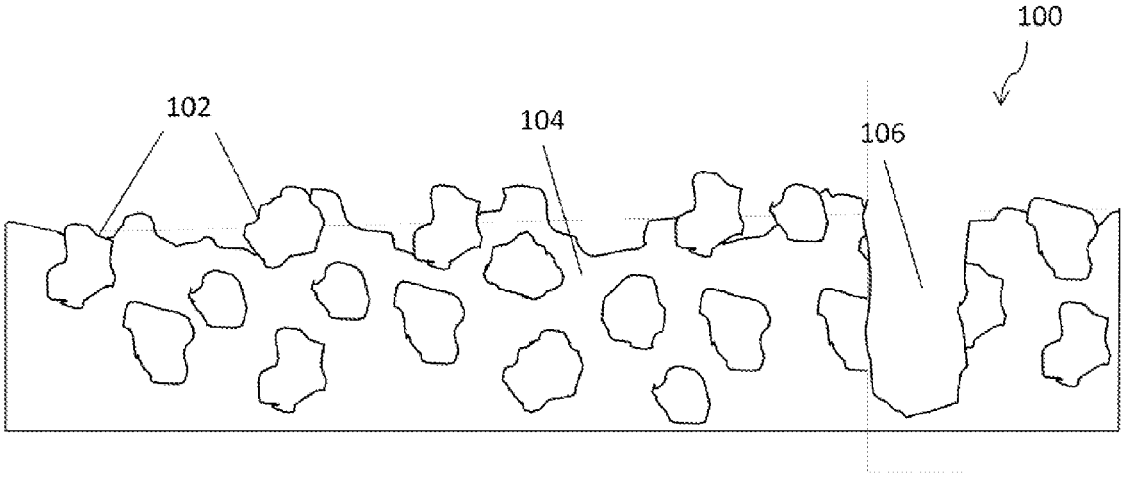
FIG. 1 is a cross-sectional view of a conventional asphalt paving system in accordance with certain embodiments.

In the following description, numerous specific details are set forth in order to provide a thorough understanding of the present invention. The present invention may be practiced without some or all of these specific details. In other instances, well known process operations have not been described in detail to not unnecessarily obscure the present invention. While the invention will be described in conjunction with specific embodiments, it will be understood that it is not intended to limit the invention to the embodiments.

Introduction

Asphalt concrete is widely used as a paving material for roadways, airport runways, parking lots and other paving applications. Standard asphalt concrete comprises a composite of a bitumen binder and a mineral aggregate such as stone, gravel, or sand, and comprises a rough top surface that. Asphalt concrete paving systems are subjected to a variety of stressors that can cause degradation of the paving system over time. For example, asphalt concrete applications are used in widely varying geographic regions, subjecting them to a broad range of temperatures, and in some regions, extreme thermal cycling. Particularly in hot temperatures, asphalt paving systems may be particularly susceptible to deformation and migration due to the impressionability of the bitumen binder. UV exposure and oxidation are also common stressors on asphalt concrete paving systems that are disposed on light-facing surfaces and that are exposed to open air. Petroleum erosion is also commonly encountered which is caused by spilling of petroleum products such as oil from vehicles onto the asphalt concrete, which can further accelerate the degradation of the paving system through corrosion of the bitumen binder that holds the asphalt concrete intact. Vehicular traffic can also be a significant stressor on asphalt concrete paving systems wherein the paving system starts to exhibit fatigue from repeated loading over time and loss of matrix from tire friction, particularly in applications such as airport tarmacs and racing tracks.

Stressors as described above can cause severe damage to asphalt concrete paving systems which may appear in various forms. For example, damage may appear in the form of an aperture such as a hole, crack, or gap. Apertures in paving systems require expensive and labor intensive repairs to prevent exacerbation of the damage as well as damage to vehicles or other equipment that utilize the paving system. Damage to the surface of the paving system can allow infiltration of water or other materials to the underlying foundation layers and compromise the structural integrity of the paving system. For example, water may shift the ground soil of the underlying layers or may cause degradation of underlying metallic structural components.

Conventional asphalt concrete paving methods and repair work is performed at high temperatures and present a multitude of emissions issues. For example, an aperture in a roadway, such as a hole, crack, or gap, is typically repaired using a tar or hot pour bituminous liquid which is commonly transferred at 150° C. (300° F.). Alternatively, the tar or hot pour bituminous liquid is mixed with diesel or kerosene for transport which then must be filtered out prior to application and is often subsequently disposed of, creating unnecessary waste. This type of repair work is expensive and labor intensive, and may need to be repeated often in areas where stressors are particularly burdensome on asphalt paving. The repair materials also typically exhibit a different color profile than the underlying asphalt concrete, resulting in an aesthetically unattractive paving application.

Moreover, concrete roadways require large quantities of heavy raw materials to be transported to the site of road building, which is prohibitively expensive if the road is to be placed in a remote location for access to mines, oil & gas pipelines, logging sites and the like. Asphalt is suitable for applications that require a high level of durability, but the cost of transporting the heavy raw aggregate and bituminous materials needed for this system is prohibitively expensive for "low vehicle" or secondary road applications.

Mechanical and chemical properties of the surface of conventional asphalt concrete paving systems pose risks to vehicles traveling thereon if the surface is left untreated. For example, conventional asphalt concrete paving systems comprise rough surfaces due to the composition of the asphalt. The roughness of the surface can be somewhat mitigated by utilization of mineral aggregate of a particular sizes. For example, a somewhat smoother surface may be achieved by utilization of a fine mineral aggregate as opposed to large-sized, jagged mineral aggregate. However, even with the use of fine mineral aggregate, the surface is rough and the asphalt concrete pavement is susceptible to issues such as deformation and loss of matrix which can cause wear on the tires of vehicles that travel on the surface. Tire replacement accounts for a large portion of operating costs in many industries such as commercial transport industries and racing industries. Other hazards are posed by the surface of conventional asphalt concrete paving systems, such as risk of hydroplaning in wet conditions due to the slick surface of the pavement. Loss of matrix, such as dislodging of loose mineral aggregate, can also cause damage vehicles by striking vehicles traveling on the surface. The rough surface can additionally make ice removal difficult as ice gets lodged in grooves of the rough topography of the surface of the pavement which can exacerbate dangerous travel conditions.

Roadway Formation

Base Layer

Reclaimer-stabilizer machines are typically used to prepare new surface materials from existing road beds by pulverizing the road bed material and compacting the remaining soil. These machines may include rotating cutting assemblies, scrapers, augers and other systems designed to pulverize, reclaim, compact, and otherwise stabilize untreated in-situ soil materials or an existing roadbed. Example reclaimer-stabilizer machines are made by Terex® with Model No.'s R350 and R446 for smaller jobs with cut depths below 10 inches, and Model No. RS950B for roadways with up to a 20 inch cut depth, suitable for forming more durable base layers in accordance with embodiments of the inventions. Within the context of this disclosure, "in-situ soil materials" refer to any pre-existing earthen materials such as sand, dust, clay, rock, and other earthen materials that are pre-existing at the site of road formation and which have not been transported thereto.

In one embodiment of the invention, a reclaimer-stabilizer machine is deployed to a site where road formation is desired. The reclaimer-stabilizer machine is engaged to form a base layer comprising in-situ soil materials by pulverizing, cutting, and/or scraping the in-situ soil materials and then compacting them into a dense or "stabilized" soil layer. Typically the base layer will be formed at 12 inches to 20 inches deep in the in-situ soil material. In some embodiments, the step of pulvering includes spraying a polyurethane composition into the soil materials at a ratio of 30 parts of in-situ soil material to 1 part liquid polyurethane, or a 30:1 weight ratio of soil to polyurethane. The inventors have found that a relatively high ratio of 30:1 of soil to polyurethane optimizes the cost of the base layer while providing an increased level of stabilization, or "R-value," to the in-situ soil materials compared with a stabilized soil system that contains polyurethane.

Within the context of this disclosure, "R-value" is calculated using California Test 301, published March, 2000 by the Department of Transportation for the State of California, and which is incorporated herein by reference in it's entirety. In relevant part, CA Test 301 states, "The R-value of a material is determined when the material is in a state of saturation such that water will be exuded from the compacted test specimen when a 16.8 kN load (2.07 MPa) is applied. Since it is not always possible to prepare a test specimen that will exude water at the specified load, it is necessary to test a series of specimens prepared at different moisture contents." Further details related to R-value testing can be found in Chapter 600 of the California Highway Design Manual.

Lower ratios of soil to polyurethane may be used to increase the level of stabilization, or R-value, as desired, for example 25:1, 22:1, or 20:1 ratios of soil to polyurethane provide increasing stability of the base layer soil. Typically however, base layers should employ ratios of greater than 22:1 for applications that will receive an additional wear layer on top of the base layer.

After formation of the base layer a wear layer is added on top of the base layer. Optionally, the base layer is allowed to cure before addition of the wear layer. Curing times for base layers comprising polyurethane are typically 8 hours to 48 hours depending on the moisture content and packing density of the base layer. The base layer may also be comprised of asphalt, cement, fly ash, or other materials commonly used to improve soil stabilization, and optionally may be given sufficient time for these materials to cure before the wear layer is added.

Wear Layer

A wear layer may be formed over the base layer using a reclaimer-stabilizer machine and adjusting it to form shallower cut than used to form the base layer described above. Although a base layer is typically formed at 12 inches to 20 inches thick, a wear layer may be in the range of 1 to 8 inches thick, preferably 4 inches thick in some embodiments. The reclaimer-stabilizer is adjusted as appropriate to make a shallower cut into the base layer at the desired thickness, for example 4 inches deep, and a liquid polyurethane mixture is applied during this process using spray heads in the reclaimer-stabilizer machine. The inventors have found that a preferred method of supplying liquid polyurethane to the reclaimer-stabilizer machine by way of a pug mill mixer in order to keep the polyurethane well mixed and capable of being readily dispensed as needed. In certain embodiments, the pug mill mixer is built-in or attached to the reclaimer-stabilizer tool. In other embodiments, the pug mill mixer is a separate system that supplies liquid polyurethane to the reclaimer-stabilizer machine and may be towed behind or transported in a separate vehicle. A preferred embodiment of pug mill mixer is a double shaft mixer with auger system, as commonly known in the art.

FIG. 1 is a cross-sectional view of a conventional asphalt paving system 100 in accordance with certain embodiments. The asphalt paving system 100 comprises a mineral aggregate 102 and a polyurethane binder 104. The asphalt paving system further comprises an aperture 106 or disruption in the surface of the asphalt paving system 100.

A reinforced or sealed paving system alleviates the roadway damage and tire wear issues described above, making the surface smoother and substantially preventing damage to the roadway from stressors such thermal cycling, UV exposure, oxidation, petroleum based erosion, and vehicular traffic as described above. The polyurethane sealing material of the present invention provides increased skid resistance and a high wet coefficient of friction to reduce risk of hydroplaning in wet conditions. The smoothed topographical surface of the present invention also improves the noise characteristics of the bituminous pathway and improves ride quality. Sealing and reinforcement of the bituminous pathway decreases matrix loss, which decreases damage to vehicles due to battering by loose mineral aggregate. Ice removal is also made easier through implementation of the smoother topographical surface.

Figure 2:
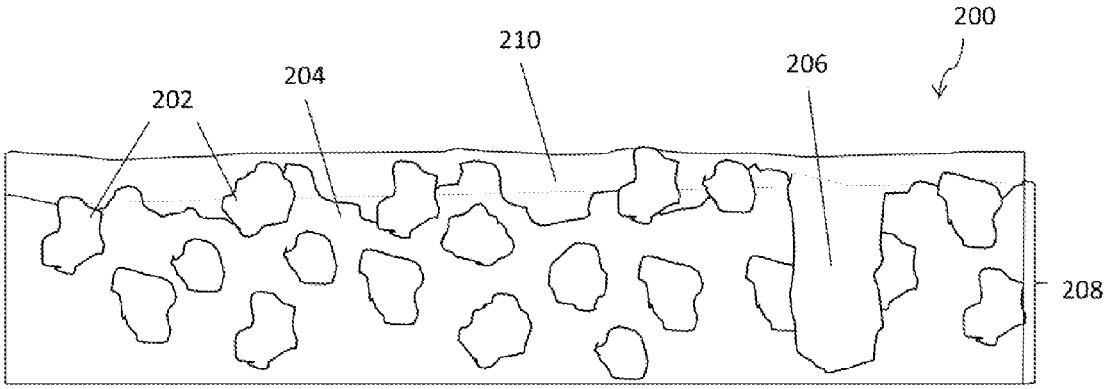
FIG. 2 is a cross-sectional view of a polyurethane based paving system in accordance with certain embodiments.

An asphalt concrete paving system may be sealed using a polyurethane-based sealing material that coats a top surface of the paving system. In certain embodiments, the sealing material may be applied by spraying a polyurethane mixture on the top surface of an asphalt concrete paving system to create a sealed bituminous pathway. FIG. 2 is a cross-sectional view of a stabilized roadway 200 in accordance with certain embodiments. The stabilized roadway 200 comprises a base layer 208 comprising mineral aggregate 202 and a in-situ soil materials 204. An aperture 206 is disposed in the base layer 208. A sealing layer 210 is disposed on the base layer 208 substantially covering a top surface of the base layer and filling the space of the aperture. The top surface of the sealing layer 210 comprises a substantially continuous and uniform topography in contrast to the top layer of the base layer 208 which comprises a jagged and disrupted topography.

In the same or other embodiments, a reinforced paving system may be provided wherein an existing asphalt concrete paving system is pulverized to form bituminous rubble and mixed with a polyurethane mixture to create a slurry. The slurry may then be distributed over a treated or untreated foundation and allowed to cure. In addition to providing a more structurally sound paving structure, these embodiments also provide a method of recycling existing asphalt paving. Recycling or reclaiming existing asphalt paving eliminates the need to acquire new mineral aggregate, saving money, reducing use of natural resources, and eliminating the need to landfill the asphalt waste. When reclamation is completed on site, transportation costs are also greatly reduced due to elimination of the need to ship in additional aggregate and the need to haul the removed asphalt paving material to a landfill.

Reclamation and recycling of paving systems that may otherwise be thrown into landfills or burned may lead to opportunities for acquisition of carbon credits for the parties involved in the installation and upkeep of the paving system. The use of a polyurethane sealing material as a sealing agent or repair agent reduces the amount of environmentally detrimental emissions that are commonly associated with standard paving installation and repair techniques and with replacement of existing paving systems. Emission reduction efforts associated with the use of polyurethane sealing materials may also provide the opportunity for acquisition of carbon credits.

The polyurethane sealing material of the present invention may be used in combination with other carbon credit programs. For example, polyurethane sealing materials may be used in combination with bioasphalts in certain embodiments. Bioasphalts may include asphalt concrete comprising bitumen made from sugar, molasses, rice, corn starch, potato starch, or from the fractional distillation of motor oil. Bioasphalts provide additional benefits in that they exhibit a variety of colors depending on the embodiment. Generally, surfaces with a lighter color absorb less heat than those of darker color. Bioasphalts are used, for example, in areas that are prone to the urban heat island effect in an effort to decrease the heat absorbed by the surface. Use of polyurethane sealing materials in combination with bioasphalts may provide the opportunity for the acquisition of additional carbon credits.

Figure 3:
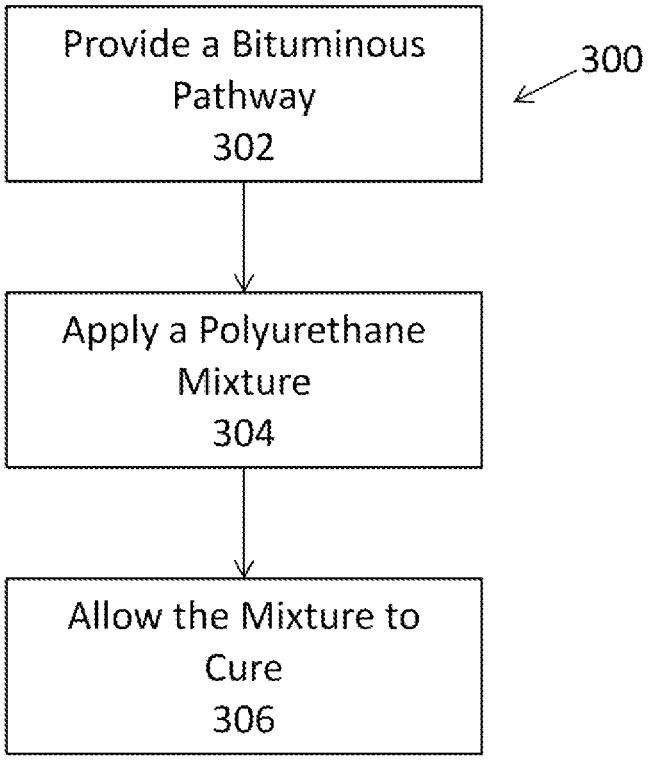
FIG. 3 is a flow chart of a process for making a polyurethane based roadway in accordance with certain embodiments.

FIG. 3 is a flow chart illustrating various operations of process 300 for making a sealed bituminous pathway in accordance with certain embodiments. Process 300 may start with providing a bituminous pathway in operation 302. Process 300 may proceed with applying a polyurethane mixture on a top surface of the bituminous pathway in operation 304. In certain embodiments, the step of applying a polyurethane mixture on a top surface of the bituminous pathway may comprise spraying the polyurethane mixture on the top surface of the bituminous pathway using an airless sprayer to form a continuous and uniform surface. In other embodiments, the step of applying a polyurethane mixture on a top surface of the bituminous pathway may comprise pouring the polyurethane mixture on the top surface of the bituminous pathway and spreading the polyurethane mixture on the top surface to form a substantially continuous and uniform surface. Process 300 may proceed by allowing the polyurethane mixture to cure to form a sealing layer in operation 306. Optionally, the step of allowing the polyurethane mixture to cure may comprise using artificial means to speed curing time, for example through the use of air streams or application of heat. Optionally, a step of applying additional surface texturing may be employed at the same time or before the step of allowing the polyurethane mixture to cure.

In certain embodiments, a reinforced bituminous pavement may be fabricated by recycling an existing asphalt paving system. For example, an existing asphalt paving system may be reclaimed on site and the asphalt concrete pulverized to form bituminous rubble of a desired size and consistency. The rubble may then be mixed with a polyurethane mixture to create a slurry which may then be applied to a foundation and allowed to cure. The polyurethane acts as a binder for the reclaimed rubble. Reclamation of the asphalt concrete may be followed by immediately pulverizing the material and mixing the polyurethane material on site using a mobile reclaimer and a mobile mixer. The polyurethane mixture in a reinforced bituminous pavement may cover an area of 20 to 50 square feet per gallon, such as 20 to 30 square feet per gallon.

Figure 4:
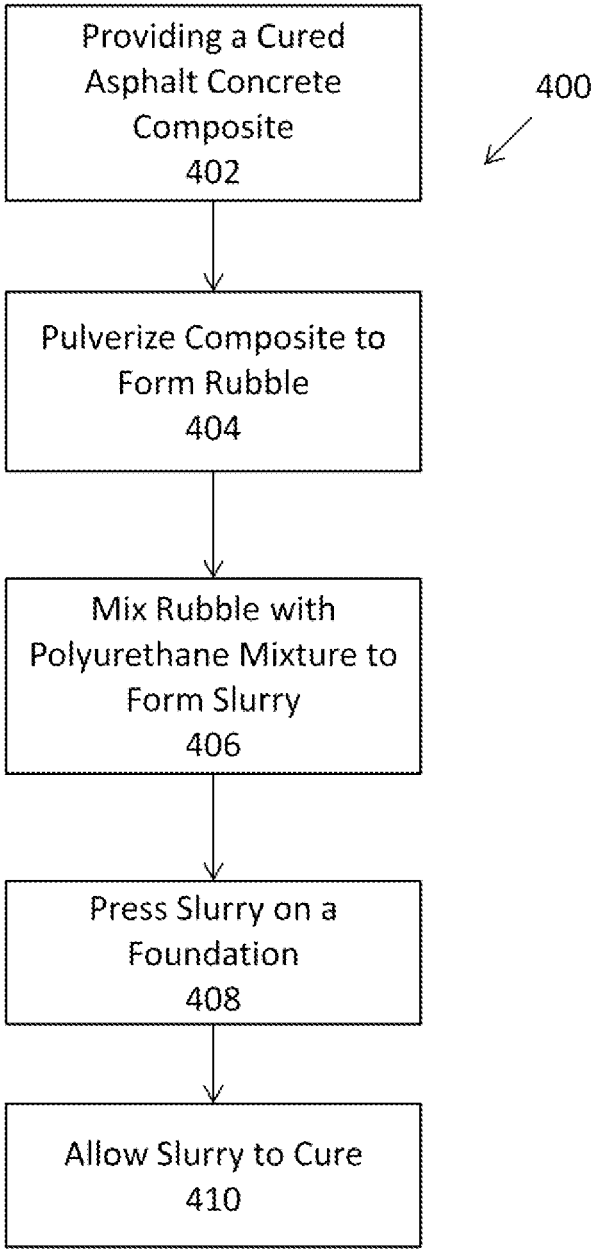
FIG. 4 is a flow chart of a process for making a reinforced polyurethane roadway in accordance with certain embodiments.

FIG. 4 is a flow chart illustrating various operations of process 400 for making a reinforced bituminous pavement in accordance with certain embodiments. Process 400 may start with providing a cured asphalt concrete composite in operation 402. Process 400 may proceed with pulverizing the cured asphalt concrete composite into bituminous rubble in operation 404. Optionally, the step of pulverizing the cured asphalt concrete composite into rubble may be preceded by a step of removing the cured asphalt concrete composite from a foundation. Process 400 may proceed with mixing the bituminous rubble with a polyurethane mixture to form a slurry in operation 406. Process 400 may proceed with pressing the slurry onto a paving foundation layer in operation 408. Optionally, process 408 may be preceded by a step of treating the paving foundation in preparation for application of the slurry. The optional step of treating a foundation may comprise smoothing or leveling of a soil layer and/or application of a gravel base layer. Process 400 may proceed with allowing the slurry to cure in operation 410. Optionally, the step of allowing the slurry to cure may comprise using artificial means to speed curing time, for example through the use of air streams or application of heat. Optionally, a step of applying additional surface texturing may be employed at the same time or before the step of allowing the slurry to cure.

Figure 5:
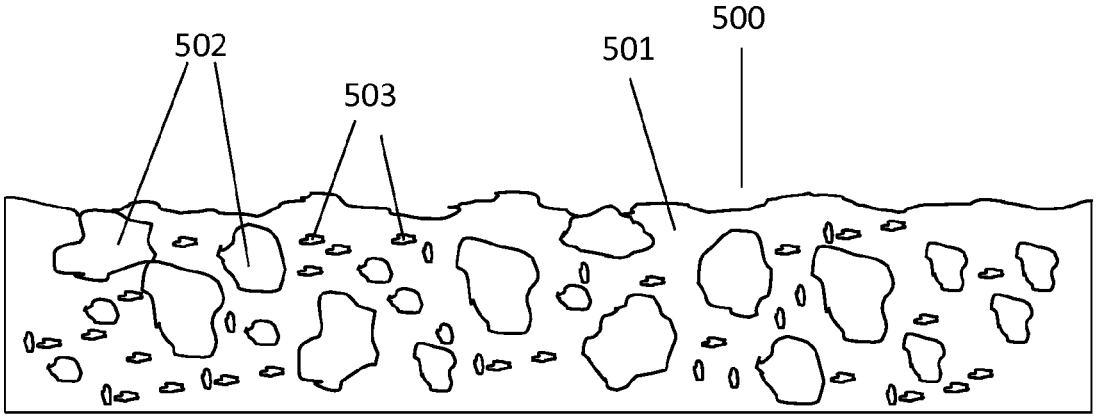
FIG. 5 is a cross-section view of a polyurethane based paving system in accordance with certain embodiments.

FIG. 5 is a cross-sectional view of a polyurethane based paving system in accordance with certain embodiments of the invention. The paving system 500 comprises a mineral aggregate 502, and small particulates of in-situ soil 503 such as sand, dust, dirt and the like. A polyurethane binder 501 is employed to improve the R-value and stability of the roadway. In this embodiment, a single pass is used to form roadway 500 and no wear layer is required.

Figure 6:
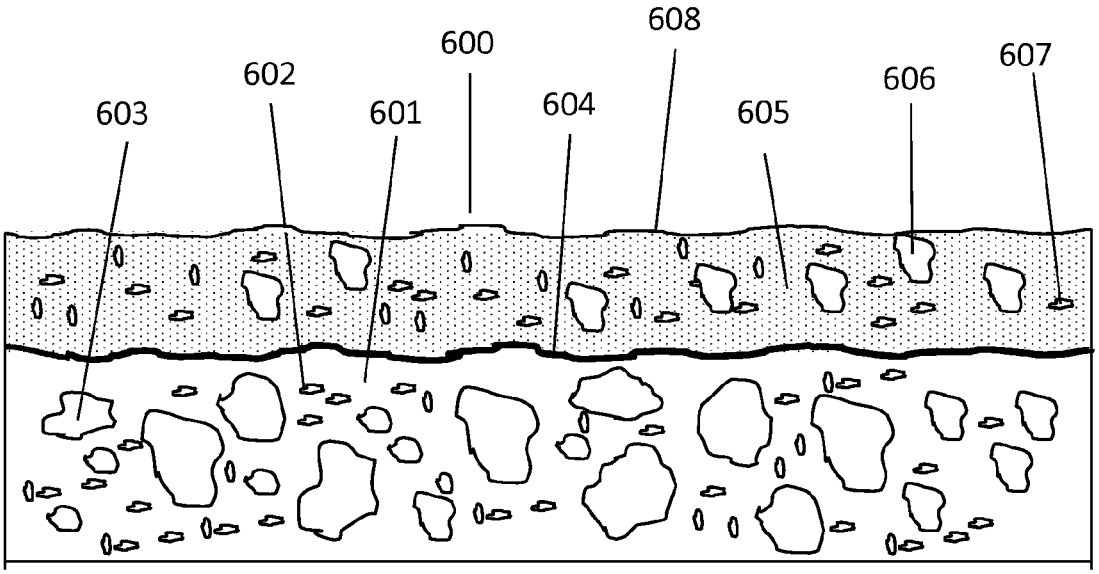
FIG. 6 is a cross-section view of a polyurethane based paving system in accordance with certain embodiments.

FIG. 6 is a cross-sectional view of a polyurethane based paving system in accordance with certain embodiments of the invention. The paving system 600 comprises a mineral aggregate 603, combined with small particulates of in-situ soil 602 such as sand, dust, dirt and the like. A polyurethane binder 601 is employed to improve the R-value and stability of base layer 604 of the roadway. In this embodiment, two separate layers of the roadway are formed using the reclaimer-stabilizer machine, base layer 604 and wear layer 608. Wear layer 608 is typically thinner than base layer 604, and is used to improve the resistance of the roadway to vehicular traffic. The base layer may be formed Polyurethane Mixture The polyurethane mixture of the present invention comprise liquid polyurethane, a heat stabilizer, and a filler material in certain embodiments. Other additives may include catalysts, dyes, pigments, surfactants, plasticizers, solvents, blowing agents, dispersants, cross linkers, flame retardants, light stabilizers, acid scavengers, antistatic agents, and antioxidants. The polyurethane mixture and application techniques will be discussed in further detail below.

Polyurethane is formed from the reaction of a monomeric or polymeric isocyanate with a polyol. In certain embodiments, prior to curing, the polyurethane sealing material of the present invention may comprise a liquid polyurethane formed from monomeric MDI or polymeric MDI. MDI polyurethanes, when used in the present invention, have been found to have favorable thermal stability as well as favorable combustion characteristics. Additionally, MDI polyurethanes in the present invention exhibit excellent adhesion to both concrete and steel. The basic structures of monomeric MDI and polymeric MDI are shown below.

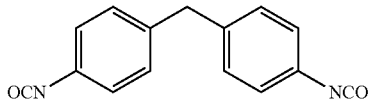

4,4′-MDI

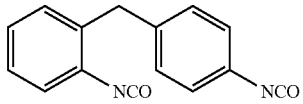

2,4′-MDI

Monomeric MDI

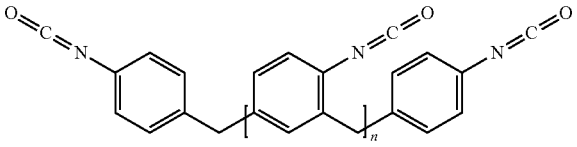

Polymeric MDI

The liquid polyurethane may further be derived from a polyol selected based on preferred viscosity and elasticity traits. For example, incorporation of a linear difunctional polyethylene glycol (polyether polyol) may result in the production of a polyurethane that is softer and more elastic while a polyfunctional polyol will result in a harder and less elastic polyurethane. A table of suitable polyols and isocyanates that may be used in accordance with certain embodiments of the invention is included below.

TABLE 1

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| Dimethyl Carbonate (DMC) | 10 | N,N-demethylcyclohexylamine | 0.05 | Desmodur N3400 | 30 | polymethylene polyphenyl isocyanate (NCO 32%) Functionality 2.4) | 59.95 |
| Dimethyl Carbonate (DMC) | 10 | N,N-demethylcyclohexylamine | 0.1 | Desmodur N3400 | 30 | polymethylene polyphenyl isocyanate (NCO 32%, Functionality 2.4) | 59.9 |
| Dimethyl Carbonate (DMC) | 10 | N,N-demethylcyclohexylamine | 0.15 | Desmodur N3400 | 30 | polymethylene polyphenyl isocyanate (NCO 32%, Functionality 2.4) | 59.85 |
| Dimethyl Carbonate (DMC) | 10 | N,N-demethylcyclohexylamine | 0.05 | Desmodur N3400 | 30 | polymethylene polyphenyl isocyanate (NCO 32%, Functionality 2.4) | 59.95 |
| Dimethyl Carbonate (DMC) | 10 | N,N-demethylcyclohexylamine | 0.1 | Desmodur N3400 | 30 | polymethylene polyphenyl isocyanate (NCO 32%, Functionality 2.4) | 59.9 |
| Dimethyl Carbonate | 10 | N,N-demethylcyclo- | 0.15 | Desmodur N3400 | 30 | polymethylene polyphenyl | 59.85 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| (DMC) | | hexylamine | | | | isocyanate (NCO 32%, Functionality 2.4) | |
| Dimethyl Carbonate (DMC) | 20 | N,N-demethylcyclo-hexylamine | 0.05 | Desmodur N3400 | 30 | polymethylene polyphenyl isocyanate (NCO 32%, Functionality 2.4) | 49.95 |
| Dimethyl Carbonate (DMC) | 20 | N,N-demethylcyclo-hexylamine | 0.1 | Desmodur N3400 | 30 | polymethylene polyphenyl isocyanate (NCO 32%, Functionality 2.4) | 49.9 |
| Dimethyl Carbonate (DMC) | 20 | N,N-demethylcyclo-hexylamine | 0.15 | Desmodur N3400 | 30 | polymethylene polyphenyl isocyanate (NCO 32%, Functionality 2.4) | 49.85 |
| Dimethyl Carbonate (DMC) | 20 | N,N-demethylcyclo-hexylamine | 0.2 | Desmodur N3400 | 30 | polymethylene polyphenyl isocyanate (NCO 32%, Functionality 2.4) | 49.8 |
| Dimethyl Carbonate (DMC) | 10 | 2,2'-dimorpholinodi-ethylether | 0.05 | Desmodur N3400 | 30 | polymethylene polyphenyl isocyanate (NCO 32%, Functionality 2.4) | 59.95 |
| Dimethyl Carbonate (DMC) | 10 | 2,2'-dimorpholinodi-ethylether | 0.1 | Desmodur N3400 | 30 | polymethylene polyphenyl isocyanate (NCO 32%, Functionality 2.4) | 59.9 |
| Dimethyl Carbonate (DMC) | 10 | 2,2'-dimorpholinodi-ethylether | 0.15 | Desmodur N3400 | 30 | polymethylene polyphenyl isocyanate (NCO 32%, Functionality 2.4) | 59.85 |
| Dimethyl Carbonate (DMC) | 10 | 2,2'-dimorpholinodi-ethylether | 0.05 | Desmodur N3400 | 30 | polymethylene polyphenyl isocyanate (NCO 32%, Functionality 2.4) | 59.95 |
| Dimethyl Carbonate (DMC) | 10 | 2,2'-dimorpholinodi-ethylether | 0.1 | Desmodur N3400 | 30 | polymethylene polyphenyl isocyanate (NCO 32%, Functionality 2.4) | 59.9 |
| Dimethyl Carbonate (DMC) | 10 | 2,2'-dimorpholinodi-ethylether | 0.15 | Desmodur N3400 | 30 | polymethylene polyphenyl isocyanate (NCO 32%, Functionality 2.4) | 59.85 |
| Dimethyl Carbonate (DMC) | 20 | 2,2'-dimorpholinodi-ethylether | 0.05 | Desmodur N3400 | 50 | polymethylene polyphenyl isocyanate (NCO 32%, Functionality 2.4) | 29.95 |
| Dimethyl Carbonate (DMC) | 20 | 2,2'-dimorpholinodi-ethylether | 0.1 | Desmodur N3400 | 50 | polymethylene polyphenyl isocyanate (NCO 32%, Functionality 2.4) | 29.9 |
| Dimethyl Carbonate (DMC) | 20 | 2,2'-dimorpholinodi-ethylether | 0.15 | Desmodur N3400 | 50 | polymethylene polyphenyl isocyanate (NCO 32%, Functionality 2.4) | 29.85 |
| Dimethyl Carbonate (DMC) | 20 | 2,2'-dimorpholinodi-ethylether | 0.2 | Desmodur N3400 | 50 | polymethylene polyphenyl isocyanate (NCO 32%, Functionality 2.4) | 29.8 |
| Dimethyl Carbonate (DMC) | 10 | dibutyl tin dilaurate | 0.05 | Desmodur N3400 | 30 | polymethylene polyphenyl isocyanate (NCO 32%, Functionality 2.4) | 59.95 |
| Dimethyl Carbonate (DMC) | 10 | dibutyl tin dilaurate | 0.1 | Desmodur N3400 | 30 | polymethylene polyphenyl isocyanate (NCO 32%, Functionality 2.4) | 59.9 |
| Dimethyl Carbonate (DMC) | 10 | dibutyl tin dilaurate | 0.15 | Desmodur N3400 | 30 | polymethylene polyphenyl isocyanate (NCO 32%, Functionality 2.4) | 59.85 |
| Dimethyl Carbonate (DMC) | 10 | dibutyl tin dilaurate | 0.05 | Desmodur N3400 | 30 | polymethylene polyphenyl isocyanate (NCO 32%, Functionality 2.4) | 59.95 |
| Dimethyl Carbonate (DMC) | 10 | dibutyl tin dilaurate | 0.1 | Desmodur N3400 | 30 | polymethylene polyphenyl isocyanate (NCO 32%, Functionality 2.4) | 59.9 |
| Dimethyl Carbonate (DMC) | 10 | dibutyl tin dilaurate | 0.15 | Desmodur N3400 | 30 | polymethylene polyphenyl isocyanate (NCO 32%, Functionality 2.4) | 59.85 |
| Dimethyl Carbonate (DMC) | 20 | dibutyl tin dilaurate | 0.05 | Desmodur N3400 | 30 | polymethylene polyphenyl isocyanate (NCO 32%, Functionality 2.4) | 49.95 |
| Dimethyl Carbonate (DMC) | 20 | dibutyl tin dilaurate | 0.1 | Desmodur N3400 | 50 | polymethylene polyphenyl isocyanate (NCO 32%, Functionality 2.4) | 29.9 |
| Dimethyl Carbonate (DMC) | 20 | dibutyl tin dilaurate | 0.15 | Desmodur N3400 | 50 | polymethylene polyphenyl isocyanate (NCO 32%, Functionality 2.4) | 29.85 |
| Dimethyl Carbonate (DMC) | 20 | dibutyl tin dilaurate | 0.2 | Desmodur N3400 | 50 | polymethylene polyphenyl isocyanate (NCO 32%, | 29.8 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| | | | | | | Functionality 2.4) | |
| Dimethyl Carbonate (DMC) | 10 | N,N-demethylcyclo-hexylamine | 0.05 | polymethylene polyphenyl isocyanate (NCO 32%, Functionality 2.4) | 30 | polymethylene polyphenyl isocyanate (NCO 32%, Functionality 2.7) | 59.95 |
| Dimethyl Carbonate (DMC) | 10 | N,N-demethylcyclo-hexylamine | 0.1 | polymethylene polyphenyl isocyanate (NCO 32%, Functionality 2.4) | 30 | polymethylene polyphenyl isocyanate (NCO 32%, Functionality 2.7) | 59.9 |
| Dimethyl Carbonate (DMC) | 10 | N,N-demethylcyclo-hexylamine | 0.15 | polymethylene polyphenyl isocyanate (NCO 32%, Functionality 2.4) | 30 | polymethylene polyphenyl isocyanate (NCO 32%, Functionality 2.7) | 59.85 |
| Dimethyl Carbonate (DMC) | 10 | N,N-demethylcyclo-hexylamine | 0.05 | polymethylene polyphenyl isocyanate (NCO 32%, Functionality 2.4) | 30 | polymethylene polyphenyl isocyanate (NCO 32%, Functionality 2.7) | 59.95 |
| Dimethyl Carbonate (DMC) | 10 | N,N-demethylcyclo-hexylamine | 0.1 | polymethylene polyphenyl isocyanate (NCO 32%, Functionality 2.4) | 30 | polymethylene polyphenyl isocyanate (NCO 32%, Functionality 2.7) | 59.9 |
| Dimethyl Carbonate (DMC) | 10 | N,N-demethylcyclo-hexylamine | 0.15 | polymethylene polyphenyl isocyanate (NCO 32%, Functionality 2.4) | 30 | polymethylene polyphenyl isocyanate (NCO 32%, Functionality 2.7) | 59.85 |
| Dimethyl Carbonate (DMC) | 20 | N,N-demethylcyclo-hexylamine | 0.05 | polymethylene polyphenyl isocyanate (NCO 32%, Functionality 2.4) | 50 | polymethylene polyphenyl isocyanate (NCO 32%, Functionality 2.7) | 29.95 |
| Dimethyl Carbonate (DMC) | 20 | N,N-demethylcyclo-hexylamine | 0.1 | polymethylene polyphenyl isocyanate (NCO 32%, Functionality 2.4) | 50 | polymethylene polyphenyl isocyanate (NCO 32%, Functionality 2.7) | 29.9 |
| Dimethyl Carbonate (DMC) | 20 | N,N-demethylcyclo-hexylamine | 0.15 | polymethylene polyphenyl isocyanate (NCO 32%, Functionality 2.4) | 50 | polymethylene polyphenyl isocyanate (NCO 32%, Functionality 2.7) | 29.85 |
| Dimethyl Carbonate (DMC) | 20 | N,N-demethylcyclo-hexylamine | 0.2 | polymethylene polyphenyl isocyanate (NCO 32%, Functionality 2.4) | 50 | polymethylene polyphenyl isocyanate (NCO 32%, Functionality 2.7) | 29.8 |
| Dimethyl Carbonate (DMC) | 10 | 2,2'-dimorpholinodi-ethylether | 0.05 | polymethylene polyphenyl isocyanate (NCO 32%, Functionality 2.4) | 30 | polymethylene polyphenyl isocyanate (NCO 32%, Functionality 2.7) | 59.95 |
| Dimethyl Carbonate (DMC) | 10 | 2,2'-dimorpholinodi-ethylether | 0.1 | polymethylene polyphenyl isocyanate (NCO 32%, Functionality 2.4) | 30 | polymethylene polyphenyl isocyanate (NCO 32%, Functionality 2.7) | 59.9 |
| Dimethyl Carbonate (DMC) | 10 | 2,2'-dimorpholinodi-ethylether | 0.15 | polymethylene polyphenyl isocyanate (NCO 32%, Functionality 2.4) | 30 | polymethylene polyphenyl isocyanate (NCO 32%, Functionality 2.7) | 59.85 |
| Dimethyl Carbonate (DMC) | 10 | 2,2'-dimorpholinodi-ethylether | 0.05 | polymethylene polyphenyl isocyanate (NCO 32% Functionality 2.4) | 30 | polymethylene polyphenyl isocyanate (NCO 32%, Functionality 2.7) | 59.95 |
| Dimethyl Carbonate (DMC) | 10 | 2,2'-dimorpholinodi-ethylether | 0.1 | polymethylene polyphenyl isocyanate (NCO 32%, Functionality 2.4) | 30 | polymethylene polyphenyl isocyanate (NCO 32%, Functionality 2.7) | 59.9 |
| Dimethyl Carbonate (DMC) | 10 | 2,2'-dimorpholinodi-ethylether | 0.15 | polymethylene polyphenyl isocyanate (NCO 32%, Functionality 2.4) | 30 | polymethylene polyphenyl isocyanate (NCO 32%, Functionality 2.7) | 59.85 |
| Dimethyl Carbonate (DMC) | 20 | 2,2'-dimorpholinodi-ethylether | 0.05 | polymethylene polyphenyl isocyanate (NCO 32%, Functionality 2.4) | 50 | polymethylene polyphenyl isocyanate (NCO 32%, Functionality 2.7) | 29.95 |
| Dimethyl Carbonate (DMC) | 20 | 2,2'-dimorpholinodi-ethylether | 0.1 | polymethylene polyphenyl isocyanate (NCO 32%, Functionality 2.4) | 50 | polymethylene polyphenyl isocyanate (NCO 32%, Functionality 2.7) | 29.9 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| Dimethyl Carbonate (DMC) | 20 | 2,2'-dimorpholinodiethylether | 0.15 | polymethylene polyphenyl isocyanate (NCO 32%, Functionality 2.4) | 50 | polymethylene polyphenyl isocyanate (NCO 32%, Functionality 2.7) | 29.85 |
| Dimethyl Carbonate (DMC) | 20 | 2,2'-dimorpholinodiethylether | 0.2 | polymethylene polyphenyl isocyanate (NCO 32%, Functionality 2.4) | 50 | polymethylene polyphenyl isocyanate (NCO 32%, Functionality 2.7) | 29.8 |
| Dimethyl Carbonate (DMC) | 10 | dibutyl tin dilaurate | 0.05 | polymethylene polyphenyl isocyanate (NCO 32%, Functionality 2.4) | 30 | polymethylene polyphenyl isocyanate (NCO 32%, Functionality 2.7) | 59.95 |
| Dimethyl Carbonate (DMC) | 10 | dibutyl tin dilaurate | 0.1 | polymethylene polyphenyl isocyanate (NCO 32%, Functionality 2.4) | 30 | polymethylene polyphenyl isocyanate (NCO 32%, Functionality 2.7) | 59.9 |
| Dimethyl Carbonate (DMC) | 10 | dibutyl tin dilaurate | 0.15 | polymethylene polyphenyl isocyanate (NCO 32%, Functionality 2.4) | 30 | polymethylene polyphenyl isocyanate (NCO 32%, Functionality 2.7) | 59.85 |
| Dimethyl Carbonate (DMC) | 10 | dibutyl tin dilaurate | 0.05 | polymethylene polyphenyl isocyanate (NCO 32%, Functionality 2.4) | 30 | polymethylene polyphenyl isocyanate (NCO 32%, Functionality 2.7) | 59.95 |
| Dimethyl Carbonate (DMC) | 10 | dibutyl tin dilaurate | 0.1 | polymethylene polyphenyl isocyanate (NCO 32%, Functionality 2.4) | 30 | polymethylene polyphenyl isocyanate (NCO 32%, Functionality 2.7) | 59.9 |
| Dimethyl Carbonate (DMC) | 10 | dibutyl tin dilaurate | 0.15 | polymethylene polyphenyl isocyanate (NCO 32%, Functionality 2.4) | 30 | polymethylene polyphenyl isocyanate (NCO 32%, Functionality 2.7) | 59.85 |
| Dimethyl Carbonate (DMC) | 20 | dibutyl tin dilaurate | 0.05 | polymethylene polyphenyl isocyanate (NCO 32%, Functionality 2.4) | 50 | polymethylene polyphenyl isocyanate (NCO 32%, Functionality 2.7) | 29.95 |
| Dimethyl Carbonate (DMC) | 20 | dibutyl tin dilaurate | 0.1 | polymethylene polyphenyl isocyanate (NCO 32%, Functionality 2.4) | 50 | polymethylene polyphenyl isocyanate (NCO 32%, Functionality 2.7) | 29.9 |
| Dimethyl Carbonate (DMC) | 20 | dibutyl tin dilaurate | 0.15 | polymethylene polyphenyl isocyanate (NCO 32%, Functionality 2.4) | 50 | polymethylene polyphenyl isocyanate (NCO 32%, Functionality 2.7) | 29.85 |
| Dimethyl Carbonate (DMC) | 20 | dibutyl tin dilaurate | 0.2 | polymethylene polyphenyl isocyanate (NCO 32%, Functionality 2.4) | 50 | polymethylene polyphenyl isocyanate (NCO 32%, Functionality 2.7) | 29.8 |
| Propylene Carbonate (PC) | 10 | N,N-demethylcyclohexylamine | 0.05 | Desmodur N3400 | 30 | polymethylene polyphenyl isocyanate (NCO 32%, Functionality 2.4) | 59.95 |
| Propylene Carbonate (PC) | 10 | N,N-demethylcyclohexylamine | 0.1 | Desmodur N3400 | 30 | polymethylene polyphenyl isocyanate (NCO 32%, Functionality 2.4) | 59.9 |
| Propylene Carbonate (PC) | 10 | N,N-demethylcyclohexylamine | 0.15 | Desmodur N3400 | 30 | polymethylene polyphenyl isocyanate (NCO 32%, Functionality 2.4) | 59.85 |
| Propylene Carbonate (PC) | 10 | N,N-demethylcyclohexylamine | 0.05 | Desmodur N3400 | 30 | polymethylene polyphenyl isocyanate (NCO 32%, Functionality 2.4) | 59.95 |
| Propylene Carbonate (PC) | 10 | N,N-demethylcyclohexylamine | 0.1 | Desmodur N3400 | 30 | polymethylene polyphenyl isocyanate (NCO 32%, Functionality 2.4) | 59.9 |
| Propylene Carbonate (PC) | 10 | N,N-demethylcyclohexylamine | 0.15 | Desmodur N3400 | 30 | polymethylene polyphenyl isocyanate (NCO 32%, Functionality 2.4) | 59.85 |
| Propylene Carbonate (PC) | 20 | N,N-demethylcyclohexylamine | 0.05 | Desmodur N3400 | 50 | polymethylene polyphenyl isocyanate (NCO 32%, Functionality 2.4) | 29.95 |
| Propylene Carbonate (PC) | 20 | N,N-demethylcyclohexylamine | 0.1 | Desmodur N3400 | 50 | polymethylene polyphenyl isocyanate (NCO 32%, Functionality 2.4) | 29.9 |
| Propylene Carbonate | 20 | N,N-demethylcyclo- | 0.15 | Desmodur N3400 | 50 | polymethylene polyphenyl | 29.85 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| (PC) | | hexylamine | | | | isocyanate (NCO 32%, Functionality 2.4) | |
| Propylene Carbonate (PC) | 20 | N,N-demethylcyclohexylamine | 0.2 | Desmodur N3400 | 50 | polymethylene polyphenyl isocyanate (NCO 32%, Functionality 2.4) | 29.8 |
| Propylene Carbonate (PC) | 10 | 2,2'-dimorpholinodiethylether | 0.05 | Desmodur N3400 | 30 | polymethylene polyphenyl isocyanate (NCO 32%, Functionality 2.4) | 59.95 |
| Propylene Carbonate (PC) | 10 | 2,2'-dimorpholinodiethylether | 0.1 | Desmodur N3400 | 30 | polymethylene polyphenyl isocyanate (NCO 32%, Functionality 2.4) | 59.9 |
| Propylene Carbonate (PC) | 10 | 2,2'-dimorpholinodiethylether | 0.15 | Desmodur N3400 | 30 | polymethylene polyphenyl isocyanate (NCO 32%, Functionality 2.4) | 59.85 |
| Propylene Carbonate (PC) | 10 | 2,2'-dimorpholinodiethylether | 0.05 | Desmodur N3400 | 30 | polymethylene polyphenyl isocyanate (NCO 32%, Functionality 2.4) | 59.95 |
| Propylene Carbonate (PC) | 10 | 2,2'-dimorpholinodiethylether | 0.1 | Desmodur N3400 | 30 | polymethylene polyphenyl isocyanate (NCO 32%, Functionality 2.4) | 59.9 |
| Propylene Carbonate (PC) | 10 | 2,2'-dimorpholinodiethylether | 0.15 | Desmodur N3400 | 30 | polymethylene polyphenyl isocyanate (NCO 32%, Functionality 2.4) | 59.85 |
| Propylene Carbonate (PC) | 20 | 2,2'-dimorpholinodiethylether | 0.05 | Desmodur N3400 | 50 | polymethylene polyphenyl isocyanate (NCO 32%, Functionality 2.4) | 29.95 |
| Propylene Carbonate (PC) | 20 | 2,2'-dimorpholinodiethylether | 0.1 | Desmodur N3400 | 50 | polymethylene polyphenyl isocyanate (NCO 32%, Functionality 2.4) | 29.9 |
| Propylene Carbonate (PC) | 20 | 2,2'-dimorpholinodiethylether | 0.15 | Desmodur N3400 | 50 | polymethylene polyphenyl isocyanate (NCO 32%, Functionality 2.4) | 29.85 |
| Propylene Carbonate (PC) | 20 | 2,2'-dimorpholinodiethylether | 0.2 | Desmodur N3400 | 50 | polymethylene polyphenyl isocyanate (NCO 32%, Functionality 2.4) | 29.8 |
| Propylene Carbonate (PC) | 10 | dibutyl tin dilaurate | 0.05 | Desmodur N3400 | 30 | polymethylene polyphenyl isocyanate (NCO 32%, Functionality 2.4) | 59.95 |
| Propylene Carbonate (PC) | 10 | dibutyl tin dilaurate | 0.1 | Desmodur N3400 | 30 | polymethylene polyphenyl isocyanate (NCO 32%, Functionality 2.4) | 59.9 |
| Propylene Carbonate (PC) | 10 | dibutyl tin dilaurate | 0.15 | Desmodur N3400 | 30 | polymethylene polyphenyl isocyanate (NCO 32%, Functionality 2.4) | 59.85 |
| Propylene Carbonate (PC) | 10 | dibutyl tin dilaurate | 0.05 | Desmodur N3400 | 30 | polymethylene polyphenyl isocyanate (NCO 32%, Functionality 2.4) | 59.95 |
| Propylene Carbonate (PC) | 10 | dibutyl tin dilaurate | 0.1 | Desmodur N3400 | 30 | polymethylene polyphenyl isocyanate (NCO 32%, Functionality 2.4) | 59.9 |
| Propylene Carbonate (PC) | 10 | dibutyl tin dilaurate | 0.15 | Desmodur N3400 | 30 | polymethylene polyphenyl isocyanate (NCO 32%, Functionality 2.4) | 59.85 |
| Propylene Carbonate (PC) | 20 | dibutyl tin dilaurate | 0.05 | Desmodur N3400 | 50 | polymethylene polyphenyl isocyanate (NCO 32%, Functionality 2.4) | 29.95 |
| Propylene Carbonate (PC) | 20 | dibutyl tin dilaurate | 0.1 | Desmodur N3400 | 50 | polymethylene polyphenyl isocyanate (NCO 32%, Functionality 2.4) | 29.9 |
| Propylene Carbonate (PC) | 20 | dibutyl tin dilaurate | 0.15 | Desmodur N3400 | 50 | polymethylene polyphenyl isocyanate (NCO 32%, Functionality 2.4) | 29.85 |
| Propylene Carbonate (PC) | 20 | dibutyl tin dilaurate | 0.2 | Desmodur N3400 | 50 | polymethylene polyphenyl isocyanate (NCO 32%, Functionality 2.4) | 29.8 |
| Propylene Carbonate (PC) | 10 | N,N-demethylcyclohexylamine | 0.05 | polymethylene polyphenyl isocyanate (NCO 32%, Functionality 24) | 30 | polymethylene polyphenyl isocyanate (NCO 32%, Functionality 2.7) | 59.95 |
| Propylene Carbonate (PC) | 10 | N,N-demethylcyclohexylamine | 0.1 | polymethylene polyphenyl isocyanate (NCO 32%, Functionality 24) | 30 | polymethylene polyphenyl isocyanate (NCO 32%, Functionality 2.7) | 59.9 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| Propylene Carbonate (PC) | 10 | N,N-demethylcyclohexylamine | 0.15 | polymethylene polyphenyl isocyanate (NCO 32%, Functionality 24) | 30 | polymethylene polyphenyl isocyanate (NCO 32%, Functionality 2.7) | 59.85 |
| Propylene Carbonate (PC) | 10 | N,N-demethylcyclohexylamine | 0.05 | polymethylene polyphenyl isocyanate (NCO 32%, Functionality 24) | 30 | polymethylene polyphenyl isocyanate (NCO 32%, Functionality 2.7) | 59.95 |
| Propylene Carbonate (PC) | 10 | N,N-demethylcyclohexylamine | 0.1 | polymethylene polyphenyl isocyanate (NCO 32%, Functionality 24) | 30 | polymethylene polyphenyl isocyanate (NCO 32%, Functionality 2.7) | 59.9 |
| Propylene Carbonate (PC) | 10 | N,N-demethylcyclohexylamine | 0.15 | polymethylene polyphenyl isocyanate (NCO 32%, Functionality 2.4) | 30 | polymethylene polyphenyl isocyanate (NCO 32%, Functionality 2.7) | 59.85 |
| Propylene Carbonate (PC) | 20 | N,N-demethylcyclohexylamine | 0.05 | polymethylene polyphenyl isocyanate (NCO 32%, Functionality 2.4) | 50 | polymethylene polyphenyl isocyanate (NCO 32%, Functionality 2.7) | 29.95 |
| Propylene Carbonate (PC) | 20 | N,N-demethylcyclohexylamine | 0.1 | polymethylene polyphenyl isocyanate (NCO 32%, Functionality 2.4) | 50 | polymethylene polyphenyl isocyanate (NCO 32%, Functionality 2.7) | 29.9 |
| Propylene Carbonate (PC) | 20 | N,N-demethylcyclohexylamine | 0.15 | polymethylene polyphenyl isocyanate (NCO 32%, Functionality 2.4) | 50 | polymethylene polyphenyl isocyanate (NCO 32%, Functionality 2.7) | 29.85 |
| Propylene Carbonate (PC) | 20 | N,N-demethylcyclohexylamine | 0.2 | polymethylene polyphenyl isocyanate (NCO 32%, Functionality 2.4) | 50 | polymethylene polyphenyl isocyanate (NCO 32%, Functionality 2.7) | 29.8 |
| Propylene Carbonate (PC) | 10 | 2,2'-dimorpholinodiethylether | 0.05 | polymethylene polyphenyl isocyanate (NCO 32%, Functionality 2.4) | 30 | polymethylene polyphenyl isocyanate (NCO 32%, Functionality 2.7) | 59.95 |
| Propylene Carbonate (PC) | 10 | 2,2'-dimorpholinodiethylether | 0.1 | polymethylene polyphenyl isocyanate (NCO 32%, Functionality 2.4) | 30 | polymethylene polyphenyl isocyanate (NCO 32%, Functionality 2.7) | 59.9 |
| Propylene Carbonate (PC) | 10 | 2,2'-dimorpholinodiethylether | 0.15 | polymethylene polyphenyl isocyanate (NCO 32%, Functionality 2.4) | 30 | polymethylene polyphenyl isocyanate (NCO 32%, Functionality 2.7) | 59.85 |
| Propylene Carbonate (PC) | 10 | 2,2'-dimorpholinodiethylether | 0.05 | polymethylene polyphenyl isocyanate (NCO 32%, Functionality 2.4) | 30 | polymethylene polyphenyl isocyanate (NCO 32%, Functionality 2.7) | 59.95 |
| Propylene Carbonate (PC) | 10 | 2,2'-dimorpholinodiethylether | 0.1 | polymethylene polyphenyl isocyanate (NCO 32%, Functionality 2.4) | 30 | polymethylene polyphenyl isocyanate (NCO 32%, Functionality 2.7) | 59.9 |
| Propylene Carbonate (PC) | 10 | 2,2'-dimorpholinodiethylether | 0.15 | polymethylene polyphenyl isocyanate (NCO 32%, Functionality 2.4) | 30 | polymethylene polyphenyl isocyanate (NCO 32%, Functionality 2.7) | 59.85 |
| Propylene Carbonate (PC) | 20 | 2,2'-dimorpholinodiethylether | 0.05 | polymethylene polyphenyl isocyanate (NCO 32%, Functionality 2.4) | 50 | polymethylene polyphenyl isocyanate (NCO 32%, Functionality 2.7) | 29.95 |
| Propylene Carbonate (PC) | 20 | 2,2'-dimorpholinodiethylether | 0.1 | polymethylene polyphenyl isocyanate (NCO 32%, Functionality 2.4) | 50 | polymethylene polyphenyl isocyanate (NCO 32%, Functionality 2.7) | 29.9 |
| Propylene Carbonate (PC) | 20 | 2,2'-dimorpholinodiethylether | 0.15 | polymethylene polyphenyl isocyanate (NCO 32%, Functionality 2.4) | 50 | polymethylene polyphenyl isocyanate (NCO 32%, Functionality 2.7) | 29.85 |
| Propylene Carbonate (PC) | 20 | 2,2'-dimorpholinodiethylether | 0.2 | polymethylene polyphenyl isocyanate (NCO 32%, Functionality 2.4) | 50 | polymethylene polyphenyl isocyanate (NCO 32%, Functionality 2.7) | 29.8 |
| Propylene Carbonate | 10 | dibutyl tin dilaurate | 0.05 | polymethylene | 30 | polymethylene polyphenyl | 59.95 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| (PC) | | | | polyphenyl isocyanate (NCO 32%, Functionality 2.4) | | isocyanate (NCO 32%, Functionality 2.7) | |
| Propylene Carbonate (PC) | 10 | dibutyl tin dilaurate | 0.1 | polymethylene polyphenyl isocyanate (NCO 32%, Functionality 2.4) | 30 | polymethylene polyphenyl isocyanate (NCO 32%, Functionality 2.7) | 59.9 |
| Propylene Carbonate (PC) | 10 | dibutyl tin dilaurate | 0.15 | polymethylene polyphenyl isocyanate (NCO 32%, Functionality 2.4) | 30 | polymethylene polyphenyl isocyanate (NCO 32%, Functionality 2.7) | 59.85 |
| Propylene Carbonate (PC) | 10 | dibutyl tin dilaurate | 0.05 | polymethylene polyphenyl isocyanate (NCO 32%, Functionality 2.4) | 30 | polymethylene polyphenyl isocyanate (NCO 32%, Functionality 2.7) | 59.95 |
| Propylene Carbonate (PC) | 10 | dibutyl tin dilaurate | 0.1 | polymethylene polyphenyl isocyanate (NCO 32%, Functionality 2.4) | 30 | polymethylene polyphenyl isocyanate (NCO 32%, Functionality 2.7) | 59.9 |
| Propylene Carbonate (PC) | 10 | dibutyl tin dilaurate | 0.15 | polymethylene polyphenyl isocyanate (NCO 32%, Functionality 2.4) | 30 | polymethylene polyphenyl isocyanate (NCO 32%, Functionality 2.7) | 59.85 |
| Propylene Carbonate (PC) | 20 | dibutyl tin dilaurate | 0.05 | polymethylene polyphenyl isocyanate (NCO 32%, Functionality 2.4) | 50 | polymethylene polyphenyl isocyanate (NCO 32%, Functionality 2.7) | 29.95 |
| Propylene Carbonate (PC) | 20 | dibutyl tin dilaurate | 0.1 | polymethylene polyphenyl isocyanate (NCO 32%, Functionality 2.4) | 50 | polymethylene polyphenyl isocyanate (NCO 32%, Functionality 2.7) | 29.9 |
| Propylene Carbonate (PC) | 20 | dibutyl tin dilaurate | 0.15 | polymethylene polyphenyl isocyanate (NCO 32%, Functionality 2.4) | 50 | polymethylene polyphenyl isocyanate (NCO 32%, Functionality 2.7) | 29.85 |
| Propylene Carbonate (PC) | 20 | dibutyl tin dilaurate | 0.2 | polymethylene polyphenyl isocyanate (NCO 32%, Functionality 2.4) | 50 | polymethylene polyphenyl isocyanate (NCO 32%, Functionality 2.7) | 29.8 |
| p-Chlorobenzotrifluoride (PCBTF) | 10 | N,N-demethylcyclo-hexylamine | 0.05 | Desmodur N3400 | 30 | polymethylene polyphenyl isocyanate (NCO 32%, Functionality 2.4) | 59.95 |
| p-Chlorobenzotrifluoride (PCBTF) | 10 | N,N-demethylcyclo-hexylamine | 0.1 | Desmodur N3400 | 30 | polymethylene polyphenyl isocyanate (NCO 32%, Functionality 2.4) | 59.9 |
| p-Chlorobenzotrifluoride (PCBTF) | 10 | N,N-demethylcyclo-hexylamine | 0.15 | Desmodur N3400 | 30 | polymethylene polyphenyl isocyanate (NCO 32%, Functionality 2.4) | 59.85 |
| p-Chlorobenzotrifluoride (PCBTF) | 10 | N,N-demethylcyclo-hexylamine | 0.05 | Desmodur N3400 | 30 | polymethylene polyphenyl isocyanate (NCO 32%, Functionality 2.4) | 59.95 |
| p-Chlorobenzotrifluoride (PCBTF) | 10 | N,N-demethylcyclo-hexylamine | 0.1 | Desmodur N3400 | 30 | polymethylene polyphenyl isocyanate (NCO 32%, Functionality 2.4) | 59.9 |
| p-Chlorobenzotrifluoride (PCBTF) | 10 | N,N-demethylcyclo-hexylamine | 0.15 | Desmodur N3400 | 30 | polymethylene polyphenyl isocyanate (NCO 32%, Functionality 2.4) | 59.85 |
| p-Chlorobenzotrifluoride (PCBTF) | 20 | N,N-demethylcyclo-hexylamine | 0.05 | Desmodur N3400 | 50 | polymethylene polyphenyl isocyanate (NCO 32%, Functionality 2.4) | 29.95 |
| p-Chlorobenzotrifluoride (PCBTF) | 20 | N,N-demethylcyclo-hexylamine | 0.1 | Desmodur N3400 | 50 | polymethylene polyphenyl isocyanate (NCO 32%, Functionality 2.4) | 29.9 |
| p-Chlorobenzotrifluoride (PCBTF) | 20 | N,N-demethylcyclo-hexylamine | 0.15 | Desmodur N3400 | 50 | polymethylene polyphenyl isocyanate (NCO 32%, Functionality 2.4) | 29.85 |
| p-Chlorobenzotrifluoride (PCBTF) | 20 | N,N-demethylcyclo-hexylamine | 0.2 | Desmodur N3400 | 50 | polymethylene polyphenyl isocyanate (NCO 32%, Functionality 2.4) | 29.8 |
| p-Chlorobenzotrifluoride (PCBTF) | 10 | 2,2'-dimorpholinodi-ethylether | 0.05 | Desmodur N3400 | 30 | polymethylene polyphenyl isocyanate (NCO 32%, Functionality 2.4) | 59.95 |
| p- | 10 | 2,2'-dimorpholinodi- | 0.1 | Desmodur N3400 | 30 | polymethylene polyphenyl | 59.9 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| Chlorobenzotrifluoride (PCBTF) | | ethylether | | | | isocyanate (NCO 32%, Functionality 2.4) | |
| p-Chlorobenzotrifluoride (PCBTF) | 10 | 2,2'-dimorpholinodi-ethylether | 0.15 | Desmodur N3400 | 30 | polymethylene polyphenyl isocyanate (NCO 32%, Functionality 2.4) | 59.85 |
| p-Chlorobenzotrifluoride (PCBTF) | 10 | 2,2'-dimorpholinodi-ethylether | 0.05 | Desmodur N3400 | 30 | polymethylene polyphenyl isocyanate (NCO 32%, Functionality 2.4) | 59.95 |
| p-Chlorobenzotrifluoride (PCBTF) | 10 | 2,2'-dimorpholinodi-ethylether | 0.1 | Desmodur N3400 | 30 | polymethylene polyphenyl isocyanate (NCO 32%, Functionality 2.4) | 59.9 |
| p-Chlorobenzotrifluoride (PCBTF) | 10 | 2,2'-dimorpholinodi-ethylether | 0.15 | Desmodur N3400 | 30 | polymethylene polyphenyl isocyanate (NCO 32%, Functionality 2.4) | 59.85 |
| p-Chlorobenzotrifluoride (PCBTF) | 20 | 2,2'-dimorpholinodi-ethylether | 0.05 | Desmodur N3400 | 50 | polymethylene polyphenyl isocyanate (NCO 32%, Functionality 2.4) | 29.95 |
| p-Chlorobenzotrifluoride (PCBTF) | 20 | 2,2'-dimorpholinodi-ethylether | 0.1 | Desmodur N3400 | 50 | polymethylene polyphenyl isocyanate (NCO 32%, Functionality 2.4 | 29.9 |
| p-Chlorobenzotrifluoride (PCBTF) | 20 | 2,2'-dimorpholinodi-ethylether | 0.15 | Desmodur N3400 | 50 | polymethylene polyphenyl isocyanate (NCO 32%, Functionality 2.4) | 29.85 |
| p-Chlorobenzotrifluoride (PCBTF) | 20 | 2,2'-dimorpholinodi-ethylether | 0.2 | Desmodur N3400 | 50 | polymethylene polyphenyl isocyanate (NCO 32%, Functionality 2.4) | 29.8 |
| p-Chlorobenzotrifluoride (PCBTF) | 10 | dibutyl tin dilaurate | 0.05 | Desmodur N3400 | 30 | polymethylene polyphenyl isocyanate (NCO 32%, Functionality 2.4) | 59.95 |
| p-Chlorobenzotrifluoride (PCBTF) | 10 | dibutyl tin dilaurate | 0.1 | Desmodur N3400 | 30 | polymethylene polyphenyl isocyanate (NCO 32%, Functionality 2.4) | 59.9 |
| p-Chlorobenzotrifluoride (PCBTF) | 10 | dibutyl tin dilaurate | 0.15 | Desmodur N3400 | 30 | polymethylene polyphenyl isocyanate (NCO 32%, Functionality 2.4) | 59.85 |
| p-Chlorobenzotrifluoride (PCBTF) | 10 | dibutyl tin dilaurate | 0.05 | Desmodur N3400 | 30 | polymethylene polyphenyl isocyanate (NCO 32%, Functionality 2.4) | 59.95 |
| p-Chlorobenzotrifluoride (PCBTF) | 10 | dibutyl tin dilaurate | 0.1 | Desmodur N3400 | 30 | polymethylene polyphenyl isocyanate (NCO 32%, Functionality 2.4) | 59.9 |
| p-Chlorobenzotrifluoride (PCBTF) | 10 | dibutyl tin dilaurate | 0.15 | Desmodur N3400 | 30 | polymethylene polyphenyl isocyanate (NCO 32%, Functionality 2.4) | 59.85 |
| p-Chlorobenzotrifluoride (PCBTF) | 20 | dibutyl tin dilaurate | 0.05 | Desmodur N3400 | 50 | polymethylene polyphenyl isocyanate (NCO 32%, Functionality 2.4) | 29.95 |
| p-Chlorobenzotrifluoride (PCBTF) | 20 | dibutyl tin dilaurate | 0.1 | Desmodur N3400 | 50 | polymethylene polyphenyl isocyanate (NCO 32%, Functionality 2.4) | 29.9 |
| p-Chlorobenzotrifluoride (PCBTF) | 20 | dibutyl tin dilaurate | 0.15 | Desmodur N3400 | 50 | polymethylene polyphenyl isocyanate (NCO 32%, Functionality 2.4) | 29.85 |
| p-Chlorobenzotrifluoride (PCBTF) | 20 | dibutyl tin dilaurate | 0.2 | Desmodur N3400 | 50 | polymethylene polyphenyl isocyanate (NCO 32%, Functionality 2.4) | 29.8 |
| p-Chlorobenzotrifluoride (PCBTF) | 10 | N,N-demethylcyclo-hexylamine | 0.05 | polymethylene polyphenyl isocyanate (NCO 32%, Functionality 2.4) | 30 | polymethylene polyphenyl isocyanate (NCO 32%, Functionality 2.7) | 59.95 |
| p-Chlorobenzotrifluoride (PCBTF) | 10 | N,N-demethylcyclo-hexylamine | 0.1 | polymethylene polyphenyl isocyanate (NCO 32%, Functionality 2.4) | 30 | polymethylene polyphenyl isocyanate (NCO 32%, Functionality 2.7) | 59.9 |
| p-Chlorobenzotrifluoride (PCBTF) | 10 | N,N-demethylcyclo-hexylamine | 0.15 | polymethylene polyphenyl isocyanate (NCO 32%, Functionality 2.4) | 30 | polymethylene polyphenyl isocyanate (NCO 32%, Functionality 2.7) | 59.85 |
| p-Chlorobenzotrifluoride (PCBTF) | 10 | N,N-demethylcyclo-hexylamine | 0.05 | polymethylene polyphenyl isocyanate (NCO 32%, Functionality 2.4) | 30 | polymethylene polyphenyl isocyanate (NCO 32%, Functionality 2.7) | 59.95 |
| p- | 10 | N,N-demethylcyclo- | 0.1 | polymethylene | 30 | polymethylene polyphenyl | 59.9 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| Chlorobenzotrifluoride (PCBTF) | | hexylamine | | polyphenyl isocyanate (NCO 32%, Functionality 2.4) | | isocyanate (NCO 32%, Functionality 2.7) | |
| p-Chlorobenzotrifluoride (PCBTF) | 10 | N,N-demethylcyclo-hexylamine | 0.15 | polymethylene polyphenyl isocyanate (NCO 32%, Functionality 2.4) | 30 | polymethylene polyphenyl isocyanate (NCO 32%, Functionality 2.7) | 59.85 |
| p-Chlorobenzotrifluoride (PCBTF) | 20 | N,N-demethylcyclo-hexylamine | 0.05 | polymethylene polyphenyl isocyanate (NCO 32%, Functionality 2.4) | 50 | polymethylene polyphenyl isocyanate (NCO 32%, Functionality 2.7) | 29.95 |
| p-Chlorobenzotrifluoride (PCBTF) | 20 | N,N-demethylcyclo-hexylamine | 0.1 | polymethylene polyphenyl isocyanate (NCO 32%, Functionality 2.4) | 50 | polymethylene polyphenyl isocyanate (NCO 32%, Functionality 2.7) | 29.9 |
| p-Chlorobenzotrifluoride (PCBTF) | 20 | N,N-demethylcyclo-hexylamine | 0.15 | polymethylene polyphenyl isocyanate (NCO 32%, Functionality 2.4) | 50 | polymethylene polyphenyl isocyanate (NCO 32%, Functionality 2.7) | 29.85 |
| p-Chlorobenzotrifluoride (PCBTF) | 20 | N,N-demethylcyclo-hexylamine | 0.2 | polymethylene polyphenyl isocyanate (NCO 32%, Functionality 2.4) | 50 | polymethylene polyphenyl isocyanate (NCO 32%, Functionality 2.7) | 29.8 |
| p-Chlorobenzotrifluoride (PCBTF) | 10 | 2,2'-dimorpholinodi-ethylether | 0.05 | polymethylene polyphenyl isocyanate (NCO 32%, Functionality 2.4) | 30 | polymethylene polyphenyl isocyanate (NCO 32%, Functionality 2.7) | 59.95 |
| p-Chlorobenzotrifluoride (PCBTF) | 10 | 2,2'-dimorpholinodi-ethylether | 0.1 | polymethylene polyphenyl isocyanate (NCO 32%, Functionality 2.4) | 30 | polymethylene polyphenyl isocyanate (NCO 32%, Functionality 2.7) | 59.9 |
| p-Chlorobenzotrifluoride (PCBTF) | 10 | 2,2'-dimorpholinodi-ethylether | 0.15 | polymethylene polyphenyl isocyanate (NCO 32%, Functionality 2.4) | 30 | polymethylene polyphenyl isocyanate (NCO 32%, Functionality 2.7) | 59.85 |
| p-Chlorobenzotrifluoride (PCBTF) | 10 | 2,2'-dimorpholinodi-ethylether | 0.05 | polymethylene polyphenyl isocyanate (NCO 32%, Functionality 2.4) | 30 | polymethylene polyphenyl isocyanate (NCO 32%, Functionality 2.7) | 59.95 |
| p-Chlorobenzotrifluoride (PCBTF) | 10 | 2,2'-dimorpholinodi-ethylether | 0.1 | polymethylene polyphenyl isocyanate (NCO 32%, Functionality 2.4) | 30 | polymethylene polyphenyl isocyanate (NCO 32%, Functionality 2.7) | 59.9 |
| p-Chlorobenzotrifluoride (PCBTF) | 10 | 2,2'-dimorpholinodi-ethylether | 0.15 | polymethylene polyphenyl isocyanate (NCO 32%, Functionality 2.4) | 30 | polymethylene polyphenyl isocyanate (NCO 32%, Functionality 2.7) | 59.85 |
| p-Chlorobenzotrifluoride (PCBTF) | 20 | 2,2'-dimorpholinodi-ethylether | 0.05 | polymethylene polyphenyl isocyanate (NCO 32%, Functionality 2.4) | 50 | polymethylene polyphenyl isocyanate (NCO 32%, Functionality 2.7) | 29.95 |
| p-Chlorobenzotrifluoride (PCBTF) | 20 | 2,2'-dimorpholinodi-ethylether | 0.1 | polymethylene polyphenyl isocyanate (NCO 32%, Functionality 2.4) | 50 | polymethylene polyphenyl isocyanate (NCO 32%, Functionality 2.7) | 29.9 |
| p-Chlorobenzotrifluoride (PCBTF) | 20 | 2,2'-dimorpholinodi-ethylether | 0.15 | polymethylene polyphenyl isocyanate (NCO 32%, Functionality 2.4) | 50 | polymethylene polyphenyl isocyanate (NCO 32%, Functionality 2.7) | 29.85 |
| p-Chlorobenzotrifluoride (PCBTF) | 20 | 2,2'-dimorpholinodi-ethylether | 0.2 | polymethylene polyphenyl isocyanate (NCO 32%, Functionality 2.4) | 50 | polymethylene polyphenyl isocyanate (NCO 32%, Functionality 2.7) | 29.8 |
| p-Chlorobenzotrifluoride (PCBTF) | 10 | dibutyl tin dilaurate | 0.05 | polymethylene polyphenyl isocyanate (NCO 32%, Functionality 2.4) | 30 | polymethylene polyphenyl isocyanate (NCO 32%, Functionality 2.7) | 59.95 |
| p-Chlorobenzotrifluoride (PCBTF) | 10 | dibutyl tin dilaurate | 0.1 | polymethylene polyphenyl isocyanate (NCO 32%, Functionality 2.4) | 30 | polymethylene polyphenyl isocyanate (NCO 32%, Functionality 2.7) | 59.9 |
| p-Chlorobenzotrifluoride | 10 | dibutyl tin dilaurate | 0.15 | polymethylene polyphenyl isocyanate | 30 | polymethylene polyphenyl isocyanate (NCO 32%, | 59.85 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| (PCBTF) | | | | (NCO 32%, Functionality 2.4) | | Functionality 2.7) | |
| p-Chlorobenzotrifluoride (PCBTF) | 10 | dibutyl tin dilaurate | 0.05 | polymethylene polyphenyl isocyanate (NCO 32%, Functionality 2.4) | 30 | polymethylene polyphenyl isocyanate (NCO 32%, Functionality 2.7) | 59.95 |
| p-Chlorobenzotrifluoride (PCBTF) | 10 | dibutyl tin dilaurate | 0.1 | polymethylene polyphenyl isocyanate (NCO 32%, Functionality 2.4) | 30 | polymethylene polyphenyl isocyanate (NCO 32%, Functionality 2.7) | 59.9 |
| p-Chlorobenzotrifluoride (PCBTF) | 10 | dibutyl tin dilaurate | 0.15 | polymethylene polyphenyl isocyanate (NCO 32%, Functionality 2.4) | 30 | polymethylene polyphenyl isocyanate (NCO 32%, Functionality 2.7) | 59.85 |
| p-Chlorobenzotrifluoride (PCBTF) | 20 | dibutyl tin dilaurate | 0.05 | polymethylene polyphenyl isocyanate (NCO 32%, Functionality 2.4) | 50 | polymethylene polyphenyl isocyanate (NCO 32%, Functionality 2.7) | 29.95 |
| p-Chlorobenzotrifluoride (PCBTF) | 20 | dibutyl tin dilaurate | 0.1 | polymethylene polyphenyl isocyanate (NCO 32%, Functionality 2.4) | 50 | polymethylene polyphenyl isocyanate (NCO 32%, Functionality 2.7) | 29.9 |
| p-Chlorobenzotrifluoride (PCBTF) | 20 | dibutyl tin dilaurate | 0.15 | polymethylene polyphenyl isocyanate (NCO 32%, Functionality 2.4) | 50 | polymethylene polyphenyl isocyanate (NCO 32%, Functionality 2.7) | 29.85 |
| p-Chlorobenzotrifluoride (PCBTF) | 20 | dibutyl tin dilaurate | 0.2 | polymethylene polyphenyl isocyanate (NCO 32%, Functionality 2.4) | 50 | polymethylene polyphenyl isocyanate (NCO 32%, Functionality 2.7) | 29.8 |
| Benzotrifluoride (BTF) | 10 | N,N-demethylcyclo-hexylamine | 0.05 | Desmodur N3400 | 30 | polymethylene polyphenyl isocyanate (NCO 32%, Functionality 2.4) | 59.95 |
| Benzotrifluoride (BTF) | 10 | N,N-demethylcyclo-hexylamine | 0.1 | Desmodur N3400 | 30 | polymethylene polyphenyl isocyanate (NCO 32%, Functionality 2.4) | 59.9 |
| Benzotrifluoride (BTF) | 10 | N,N-demethylcyclo-hexylamine | 0.15 | Desmodur N3400 | 30 | polymethylene polyphenyl isocyanate (NCO 32%, Functionality 2.4) | 59.85 |
| Benzotrifluoride (BTF) | 10 | N,N-demethylcyclo-hexylamine | 0.05 | Desmodur N3400 | 30 | polymethylene polyphenyl isocyanate (NCO 32%, Functionality 2.4) | 59.95 |
| Benzotrifluoride (BTF) | 10 | N,N-demethylcyclo-hexylamine | 0.1 | Desmodur N3400 | 30 | polymethylene polyphenyl isocyanate (NCO 32%, Functionality 2.4) | 59.9 |
| Benzotrifluoride (BTF) | 10 | N,N-demethylcyclo-hexylamine | 0.15 | Desmodur N3400 | 30 | polymethylene polyphenyl isocyanate (NCO 32%, Functionality 2.4) | 59.85 |
| Benzotrifluoride (BTF) | 20 | N,N-demethylcyclo-hexylamine | 0.05 | Desmodur N3400 | 50 | polymethylene polyphenyl isocyanate (NCO 32%, Functionality 2.4) | 29.95 |
| Benzotrifluoride (BTF) | 20 | N,N-demethylcyclo-hexylamine | 0.1 | Desmodur N3400 | 50 | polymethylene polyphenyl isocyanate (NCO 32%, Functionality 2.4) | 29.9 |
| Benzotrifluoride (BTF) | 20 | N,N-demethylcyclo-hexylamine | 0.15 | Desmodur N3400 | 50 | polymethylene polyphenyl isocyanate (NCO 32%, Functionality 2.4) | 29.85 |
| Benzotrifluoride (BTF) | 20 | N,N-demethylcyclo-hexylamine | 0.2 | Desmodur N3400 | 50 | polymethylene polyphenyl isocyanate (NCO 32%, Functionality 2.4) | 29.8 |
| Benzotrifluoride (BTF) | 10 | 2,2'-dimorpholinodi-ethylether | 0.05 | Desmodur N3400 | 30 | polymethylene polyphenyl isocyanate (NCO 32%, Functionality 2.4) | 59.95 |
| Benzotrifluoride (BTF) | 10 | 2,2'-dimorpholinodi-ethylether | 0.1 | Desmodur N3400 | 30 | polymethylene polyphenyl isocyanate (NCO 32%, Functionality 2.4) | 59.9 |
| Benzotrifluoride (BTF) | 10 | 2,2'-dimorpholinodi-ethylether | 0.15 | Desmodur N3400 | 30 | polymethylene polyphenyl isocyanate (NCO 32%, Functionality 24) | 59.85 |
| Benzotrifluoride (BTF) | 10 | 2,2'-dimorpholinodi-ethylether | 0.05 | Desmodur N3400 | 30 | polymethylene polyphenyl isocyanate (NCO 32%, Functionality 2.4) | 59.95 |
| Benzotrifluoride | 10 | 2,2'-dimorpholinodi- | 0.1 | Desmodur N3400 | 30 | polymethylene polyphenyl | 59.9 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| (BTF) | | ethylether | | | | isocyanate (NCO 32%, Functionality 2.4) | |
| Benzotrifluoride (BTF) | 10 | 2,2'-dimorpholinodi-ethylether | 0.15 | Desmodur N3400 | 30 | polymethylene polyphenyl isocyanate (NCO 32%, Functionality 2.4) | 59.85 |
| Benzotrifluoride (BTF) | 20 | 2,2'-dimorpholinodi-ethylether | 0.05 | Desmodur N3400 | 50 | polymethylene polyphenyl isocyanate (NCO 32%, Functionality 2.4) | 29.95 |
| Benzotrifluoride (BTF) | 20 | 2,2'-dimorpholinodi-ethylether | 0.1 | Desmodur N3400 | 50 | polymethylene polyphenyl isocyanate (NCO 32%, Functionality 2.4) | 29.9 |
| Benzotrifluoride (BTF) | 20 | 2,2'-dimorpholinodi-ethylether | 0.15 | Desmodur N3400 | 50 | polymethylene polyphenyl isocyanate (NCO 32%, Functionality 2.4) | 29.85 |
| Benzotrifluoride (BTF) | 20 | 2,2'-dimorpholinodi-ethylether | 0.2 | Desmodur N3400 | 50 | polymethylene polyphenyl isocyanate (NCO 32%, Functionality 2.4) | 29.8 |
| Benzotrifluoride (BTF) | 10 | dibutyl tin dilaurate | 0.05 | Desmodur N3400 | 30 | polymethylene polyphenyl isocyanate (NCO 32%, Functionality 2.4) | 59.95 |
| Benzotrifluoride (BTF) | 10 | dibutyl tin dilaurate | 0.1 | Desmodur N3400 | 30 | polymethylene polyphenyl isocyanate (NCO 32%, Functionality 2.4) | 59.9 |
| Benzotrifluoride (BTF) | 10 | dibutyl tin dilaurate | 0.15 | Desmodur N3400 | 30 | polymethylene polyphenyl isocyanate (NCO 32%, Functionality 2.4) | 59.85 |
| Benzotrifluoride (BTF) | 10 | dibutyl tin dilaurate | 0.05 | Desmodur N3400 | 30 | polymethylene polyphenyl isocyanate (NCO 32%, Functionality 2.4) | 59.95 |
| Benzotrifluoride (BTF) | 10 | dibutyl tin dilaurate | 0.1 | Desmodur N3400 | 30 | polymethylene polyphenyl isocyanate (NCO 32%, Functionality 2.4) | 59.9 |
| Benzotrifluoride (BTF) | 10 | dibutyl tin dilaurate | 0.15 | Desmodur N3400 | 30 | polymethylene polyphenyl isocyanate (NCO 32%, Functionality 2.4) | 59.85 |
| Benzotrifluoride (BTF) | 20 | dibutyl tin dilaurate | 0.05 | Desmodur N3400 | 50 | polymethylene polyphenyl isocayanate (NCO 32%, Functionality 2.4) | 29.95 |
| Benzotrifluoride (BTF) | 20 | dibutyl tin dilaurate | 0.1 | Desmodur N3400 | 50 | polymethylene polyphenyl isocayanate (NCO 32%, Functionality 2.4) | 29.9 |
| Benzotrifluoride (BTF) | 20 | dibutyl tin dilaurate | 0.15 | Desmodur N3400 | 50 | polymethylene polyphenyl isocayanate (NCO 32%, Functionality 2.4) | 29.85 |
| Benzotrifluoride (BTF) | 20 | dibutyl tin dilaurate | 0.2 | Desmodur N3400 | 50 | polymethylene polyphenyl isocayanate (NCO 32%, Functionality 2.4) | 29.8 |
| Benzotrifluoride (BTF) | 10 | N,N-demethylcyclo-hexylamine | 0.05 | polymethylene polyphenyl isocyanate (NCO 32%, Functionality 2.4) | 30 | polymethylene polyphenyl isocayanate (NCO 32%, Functionality 2.7) | 59.95 |
| Benzotrifluoride (BTF) | 10 | N,N-demethylcyclo-hexylamine | 0.1 | polymethylene polyphenyl isocyanate (NCO 32%, Functionality 2.4) | 30 | polymethylene polyphenyl isocayanate (NCO 32%, Functionality 2.7) | 59.9 |
| Benzotrifluoride (BTF) | 10 | N,N-demethylcyclo-hexylamine | 0.15 | polymethylene polyphenyl isocyanate (NCO 32%, Functionality 2.4) | 30 | polymethylene polyphenyl isocayanate (NCO 32%, Functionality 2.7) | 59.85 |
| Benzotrifluoride (BTF) | 10 | N,N-demethylcyclo hexylamine | 0.05 | polymethylene polyphenyl isocyanate (NCO 32%, Functionality 2.4) | 30 | polymethylene polyphenyl isocayanate (NCO 32%, Functionality 2.7) | 59.95 |
| Benzotrifluoride (BTF) | 10 | N,N-demethylcyclo-hexylamine | 0.1 | polymethylene polyphenyl isocyanate (NCO 32%, Functionality 2.4) | 30 | polymethylene polyphenyl isocayanate (NCO 32%, Functionality 2.7) | 59.9 |
| Benzotrifluoride (BTF) | 10 | N,N-demethylcyclo-hexylamine | 0.15 | polymethylene polyphenyl isocyanate (NCO 32%, Functionality 2.4) | 30 | polymethylene polyphenyl isocayanate (NCO 32%, Functionality 2.7) | 59.85 |
| Benzotrifluoride (BTF) | 20 | N,N-demethylcyclo-hexylamine | 0.05 | polymethylene polyphenyl isocyanate | 50 | polymethylene polyphenyl isocayanate (NCO 32%, | 29.95 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| | | | | (NCO 32%, Functionality 2.4) | | Functionality 2.7) | |
| Benzotrifluoride (BTF) | 20 | N,N-demethylcyclohexylamine | 0.1 | polymethylene polyphenyl isocyanate (NCO 32%, Functionality 2.4) | 50 | polymethylene polyphenyl isocayanate (NCO 32%, Functionality 2.7) | 29.9 |
| Benzotrifluoride (BTF) | 20 | N,N-demethylcyclohexylamine | 0.15 | polymethylene polyphenyl isocyanate (NCO 32%, Functionality 2.4) | 50 | polymethylene polyphenyl isocayanate (NCO 32%, Functionality 2.7) | 29.85 |
| Benzotrifluoride (BTF) | 20 | N,N-demethylcyclohexylamine | 0.2 | polymethylene polyphenyl isocyanate (NCO 32%, Functionality 2.4) | 50 | polymethylene polyphenyl isocyanate (NCO 32%, Functionality 2.7) | 29.8 |
| Benzotrifluoride (BTF) | 10 | 2,2'-dimorpholinodiethylether | 0.05 | polymethylene polyphenyl isocyanate (NCO 32%, Functionality 2.4) | 30 | polymethylene polyphenyl isocayanate (NCO 32%, Functionality 2.7) | 59.95 |
| Benzotrifluoride (BTF) | 10 | 2,2'-dimorpholinodiethylether | 0.1 | polymethylene polyphenyl isocyanate (NCO 32%, Functionality 2.4) | 30 | polymethylene polyphenyl isocayanate (NCO 32%, Functionality 2.7) | 59.9 |
| Benzotrifluoride (BTF) | 10 | 2,2'-dimorpholinodiethylether | 0.15 | polymethylene polyphenyl isocyanate (NCO 32%, Functionality 2.4) | 30 | polymethylene polyphenyl isocayanate (NCO 32%, Functionality 2.7) | 59.85 |
| Benzotrifluoride (BTF) | 10 | 2,2'-dimorpholinodiethylether | 0.05 | polymethylene polyphenyl isocyanate (NCO 32%, Functionality 2.4) | 30 | polymethylene polyphenyl isocayanate (NCO 32%, Functionality 2.7) | 59.95 |
| Benzotrifluoride (BTF) | 10 | 2,2'-dimorpholinodiethylether | 0.1 | polymethylene polyphenyl isocyanate (NCO 32%, Functionality 2.4) | 30 | polymethylene polyphenyl isocayanate (NCO 32%, Functionality 2.7) | 59.9 |
| Benzotrifluoride (BTF) | 10 | 2,2'-dimorpholinodiethylether | 0.15 | polymethylene polyphenyl isocyanate (NCO 32%, Functionality 2.4) | 30 | polymethylene polyphenyl isocayanate (NCO 32%, Functionality 2.7) | 59.85 |
| Benzotrifluoride (BTF) | 20 | 2,2'-dimorpholinodiethylether | 0.05 | polymethylene polyphenyl isocyanate (NCO 32%, Functionality 2.4) | 50 | polymethylene polyphenyl isocayanate (NCO 32%, Functionality 2.7) | 29.95 |
| Benzotrifluoride (BTF) | 20 | 2,2'-dimorpholinodiethylether | 0.1 | polymethylene polyphenyl isocyanate (NCO 32%, Functionality 2.4) | 50 | polymethylene polyphenyl isocayanate (NCO 32%, Functionality 2.7) | 29.9 |
| Benzotrifluoride (BTF) | 20 | 2,2'-dimorpholinodiethylether | 0.15 | polymethylene polyphenyl isocyanate (NCO 32%, Functionality 2.4) | 50 | polymethylene polyphenyl isocayanate (NCO 32%, Functionality 2.7) | 29.85 |
| Benzotrifluoride (BTF) | 20 | 2,2'-dimorpholinodiethylether | 0.2 | polymethylene polyphenyl isocyanate (NCO 32%, Functionality 2.4) | 50 | polymethylene polyphenyl isocayanate (NCO 32%, Functionality 2.7) | 29.8 |
| Benzotrifluoride (BTF) | 10 | dibutyl tin dilaurate | 0.05 | polymethylene polyphenyl isocyanate (NCO 32%, Functionality 2.4) | 30 | polymethylene polyphenyl isocayanate (NCO 32%, Functionality 2.7) | 59.95 |
| Benzotrifluoride (BTF) | 10 | dibutyl tin dilaurate | 0.1 | polymethylene polyphenyl isocyanate (NCO 32%, Functionality 2.4) | 30 | polymethylene polyphenyl isocayanate (NCO 32%, Functionality 2.7) | 59.9 |
| Benzotrifluoride (BTF) | 10 | dibutyl tin dilaurate | 0.15 | polymethylene polyphenyl isocyanate (NCO 32%, Functionality 2.4) | 30 | polymethylene polyphenyl isocayanate (NCO 32%, Functionality 2.7) | 59.85 |
| Benzotrifluoride (BTF) | 10 | dibutyl tin dilaurate | 0.05 | polymethylene polyphenyl isocyanate (NCO 32%, Functionality 2.4) | 30 | polymethylene polyphenyl isocayanate (NCO 32%, Functionality 2.7) | 59.95 |
| Benzotrifluoride (BTF) | 10 | dibutyl tin dilaurate | 0.1 | polymethylene polyphenyl isocyanate (NCO 32%, | 30 | polymethylene polyphenyl isocayanate (NCO 32%, Functionality 2.7) | 59.9 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| | | | | Functionality 2.4) | | | |
| Benzotrifluoride (BTF) | 10 | dibutyl tin dilaurate | 0.15 | polymethylene polyphenyl isocyanate (NCO 32%, Functionality 2.4) | 30 | polymethylene polyphenyl isocayanate (NCO 32%, Functionality 2.7) | 59.85 |
| Benzotrifluoride (BTF) | 20 | dibutyl tin dilaurate | 0.05 | polymethylene polyphenyl isocyanate (NCO 32%, Functionality 2.4) | 50 | polymethylene polyphenyl isocayanate (NCO 32%, Functionality 2.7) | 29.95 |
| Benzotrifluoride (BTF) | 20 | dibutyl tin dilaurate | 0.1 | polymethylene polyphenyl isocyanate (NCO 32%, Functionality 2.4) | 50 | polymethylene polyphenyl isocayanate (NCO 32%, Functionality 2.7) | 29.9 |
| Benzotrifluoride (BTF) | 20 | dibutyl tin dilaurate | 0.15 | polymethylene polyphenyl isocyanate (NCO 32%, Functionality 2.4) | 50 | polymethylene polyphenyl isocayanate (NCO 32%, Functionality 2.7) | 29.85 |
| Benzotrifluoride (BTF) | 20 | dibutyl tin dilaurate | 0.2 | polymethylene polyphenyl isocyanate (NCO 32%, Functionality 2.4) | 50 | polymethylene polyphenyl isocayanate (NCO 32%, Functionality 2.7) | 29.8 |
| Tertiary-butyl acetate (TBAC) | 10 | N,N-demethylcyclo-hexylamine | 0.05 | Desmodur N3400 | 30 | polymethylene polyphenyl isocyanate (NCO 32%, Functionality 2.4) | 59.95 |
| Tertiary-butyl acetate (TBAC) | 10 | N,N-demethylcyclo-hexylamine | 0.1 | Desmodur N3400 | 30 | polymethylene polyphenyl isocyanate (NCO 32%, Functionality 2.4) | 59.9 |
| Tertiary-butyl acetate (TBAC) | 10 | N,N-demethylcyclo-hexylamine | 0.15 | Desmodur N3400 | 30 | polymethylene polyphenyl isocyanate (NCO 32%, Functionality 2.4) | 59.85 |
| Tertiary-butyl acetate (TBAC) | 10 | N,N-demethylcyclo-hexylamine | 0.05 | Desmodur N3400 | 30 | polymethylene polyphenyl isocyanate (NCO 32%, Functionality 2.4) | 59.95 |
| Tertiary-butyl acetate (TBAC) | 10 | N,N-demethylcyclo-hexylamine | 0.1 | Desmodur N3400 | 30 | polymethylene polyphenyl isocyanate (NCO 32%, Functionality 2.4) | 59.9 |
| Tertiary-butyl acetate (TBAC) | 10 | N,N-demethylcyclo-hexylamine | 0.15 | Desmodur N3400 | 30 | polymethylene polyphenyl isocyanate (NCO 32%, Functionality 2.4) | 59.85 |
| Tertiary-butyl acetate (TBAC) | 20 | N,N-demethylcyclo-hexylamine | 0.05 | Desmodur N3400 | 50 | polymethylene polyphenyl isocyanate (NCO 32%, Functionality 2.4) | 29.95 |
| Tertiary-butyl acetate (TBAC) | 20 | N,N-demethylcyclo-hexylamine | 0.1 | Desmodur N3400 | 50 | polymethylene polyphenyl isocyanate (NCO 32%, Functionality 2.4) | 29.9 |
| Tertiary-butyl acetate (TBAC) | 20 | N,N-demethylcyclo-hexylamine | 0.15 | Desmodur N3400 | 50 | polymethylene polyphenyl isocyanate (NCO 32%, Functionality 2.4) | 29.85 |
| Tertiary-butyl acetate (TBAC) | 20 | N,N-demethylcyclo-hexylamine | 0.2 | Desmodur N3400 | 50 | polymethylene polyphenyl isocyanate (NCO 32%, Functionality 2.4) | 29.8 |
| Tertiary-butyl acetate (TBAC) | 10 | 2,2'-dimorpholinodi-ethylether | 0.05 | Desmodur N3400 | 30 | polymethylene polyphenyl isocyanate (NCO 32%, Functionality 2.4) | 59.95 |
| Tertiary-butyl acetate (TBAC) | 10 | 2,2'-dimorpholinodi-ethylether | 0.1 | Desmodur N3400 | 30 | polymethylene polyphenyl isocyanate (NCO 32%, Functionality 2.4) | 59.9 |
| Tertiary-butyl acetate (TBAC) | 10 | 2,2'-dimorpholinodi-ethylether | 0.15 | Desmodur N3400 | 30 | polymethylene polyphenyl isocyanate (NCO 32%, Functionality 2.4) | 59.85 |
| Tertiary-butyl acetate (TBAC) | 10 | 2,2'-dimorpholinodi-ethylether | 0.05 | Desmodur N3400 | 30 | polymethylene polyphenyl isocyanate (NCO 32%, Functionality 2.4) | 59.95 |
| Tertiary-butyl acetate (TBAC) | 10 | 2,2'-dimorpholinodi-ethylether | 0.1 | Desmodur N3400 | 30 | polymethylene polyphenyl isocyanate (NCO 32%, Functionality 2.4) | 59.9 |
| Tertiary-butyl acetate (TBAC) | 10 | 2,2'-dimorpholinodi-ethylether | 0.15 | Desmodur N3400 | 30 | polymethylene polyphenyl isocyanate (NCO 32%, Functionality 2.4) | 59.85 |
| Tertiary-butyl acetate (TBAC) | 20 | 2,2'-dimorpholinodi-ethylether | 0.05 | Desmodur N3400 | 50 | polymethylene polyphenyl isocyanate (NCO 32%, Functionality 2.4) | 29.95 |
| Tertiary-butyl | 20 | 2,2'-dimorpholinodi- | 0.1 | Desmodur N3400 | 50 | polymethylene polyphenyl | 29.9 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| acetate (TBAC) | | ethylether | | | | isocyanate (NCO 32%, Functionality 2.4) | |
| Tertiary-butyl acetate (TBAC) | 20 | 2,2'-dimorpholinodi-ethylether | 0.15 | Desmodur N3400 | 50 | polymethylene polyphenyl isocyanate (NCO 32%, Functionality 2.4) | 29.85 |
| Tertiary-butyl acetate (TBAC) | 20 | 2,2'-dimorpholinodi-ethylether | 0.2 | Desmodur N3400 | 50 | polymethylene polyphenyl isocyanate (NCO 32%, Functionality 2.4) | 29.8 |
| Tertiary-butyl acetate (TBAC) | 10 | dibutyl tin dilaurate | 0.05 | Desmodur N3400 | 30 | polymethylene polyphenyl isocyanate (NCO 32%, Functionality 2.4) | 59.95 |
| Tertiary-butyl acetate (TBAC) | 10 | dibutyl tin dilaurate | 0.1 | Desmodur N3400 | 30 | polymethylene polyphenyl isocyanate (NCO 32%, Functionality 2.4) | 59.9 |
| Tertiary-butyl acetate (TBAC) | 10 | dibutyl tin dilaurate | 0.15 | Desmodur N3400 | 30 | polymethylene polyphenyl isocyanate (NCO 32%, Functionality 2.4) | 59.85 |
| Tertiary-butyl acetate (TBAC) | 10 | dibutyl tin dilaurate | 0.05 | Desmodur N3400 | 30 | polymethylene polyphenyl isocyanate (NCO 32%, Functionality 2.4) | 59.95 |
| Tertiary-butyl acetate (TBAC) | 10 | dibutyl tin dilaurate | 0.1 | Desmodur N3400 | 30 | polymethylene polyphenyl isocyanate (NCO 32%, Functionality 2.4) | 59.9 |
| Tertiary-butyl acetate (TBAC) | 10 | dibutyl tin dilaurate | 0.15 | Desmodur N3400 | 30 | polymethylene polyphenyl isocyanate (NCO 32%, Functionality 2.4) | 59.85 |
| Tertiary-butyl acetate (TBAC) | 20 | dibutyl tin dilaurate | 0.05 | Desmodur N3400 | 50 | polymethylene polyphenyl isocyanate (NCO 32%, Functionality 2.4) | 29.95 |
| Tertiary-butyl acetate (TBAC) | 20 | dibutyl tin dilaurate | 0.1 | Desmodur N3400 | 50 | polymethylene polyphenyl isocyanate (NCO 32%, Functionality 2.4) | 29.9 |
| Tertiary-butyl acetate (TBAC) | 20 | dibutyl tin dilaurate | 0.15 | Desmodur N3400 | 50 | polymethylene polyphenyl isocyanate (NCO 32%, Functionality 2.4) | 29.85 |
| Tertiary-butyl acetate (TBAC) | 20 | dibutyl tin dilaurate | 0.2 | Desmodur N3400 | 50 | polymethylene polyphenyl isocyanate (NCO 32%, Functionality 2.4) | 29.8 |
| Tertiary-butyl acetate (TBAC) | 10 | N,N-demethylcyclo-hexylamine | 0.05 | polymethylene polyphenyl isocyanate (NCO 32% Functionality 2.4) | 30 | polymethylene polyphenyl isocyanate (NCO 32%, Functionality 2.7) | 59.95 |
| Tertiary-butyl acetate (TBAC) | 10 | N,N-demethylcyclo-hexylamine | 0.1 | polymethylene polyphenyl isocyanate (NCO 32% Functionality 2.4) | 30 | polymethylene polyphenyl isocyanate (NCO 32%, Functionality 2.7) | 59.9 |
| Tertiary-butyl acetate (TBAC) | 10 | N,N-demethylcyclo-hexylamine | 0.15 | polymethylene polyphenyl isocyanate (NCO 32% Functionality 2.4) | 30 | polymethylene polyphenyl isocyanate (NCO 32%, Functionality 2.7) | 59.85 |
| Tertiary-butyl acetate (TBAC) | 10 | N,N-demethylcyclo-hexylamine | 0.05 | polymethylene polyphenyl isocyanate (NCO 32% Functionality 2.4) | 30 | polymethylene polyphenyl isocyanate (NCO 32%, Functionality 2.7) | 59.95 |
| Tertiary-butyl acetate (TBAC) | 10 | N,N-demethylcyclo-hexylamine | 0.1 | polymethylene polyphenyl isocyanate (NCO 32% Functionality 2.4) | 30 | polymethylene polyphenyl isocyanate (NCO 32%, Functionality 2.7) | 59.9 |
| Tertiary-butyl acetate (TBAC) | 10 | N,N-demethylcyclo-hexylamine | 0.15 | polymethylene polyphenyl isocyanate (NCO 32% Functionality 2.4) | 30 | polymethylene polyphenyl isocyanate (NCO 32%, Functionality 2.7) | 59.85 |
| Tertiary-butyl acetate (TBAC) | 20 | N,N-demethylcyclo-hexylamine | 0.05 | polymethylene polyphenyl isocyanate (NCO 32% Functionality 2.4) | 50 | polymethylene polyphenyl isocyanate (NCO 32%, Functionality 2.7) | 29.95 |
| Tertiary-butyl acetate (TBAC) | 20 | N,N-demethylcyclo-hexylamine | 0.1 | polymethylene polyphenyl isocyanate (NCO 32% Functionality 2.4) | 50 | polymethylene polyphenyl isocyanate (NCO 32%, Functionality 2.7) | 29.9 |
| Tertiary-butyl acetate (TBAC) | 20 | N,N-demethylcyclo-hexylamine | 0.15 | polymethylene polyphenyl isocyanate (NCO 32% | 50 | polymethylene polyphenyl isocyanate (NCO 32%, Functionality 2.7) | 29.85 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| | | | | Functionality 2.4) | | | |
| Tertiary-butyl acetate (TBAC) | 20 | N,N-demethylcyclo-hexylamine | 0.2 | polymethylene polyphenyl isocyanate (NCO 32% Functionality 2.4) | 50 | polymethylene polyphenyl isocyanate (NCO 32%, Functionality 2.7) | 29.8 |
| Tertiary-butyl acetate (TBAC) | 10 | 2,2'-dimorpholinodi-ethylether | 0.05 | polymethylene polyphenyl isocyanate (NCO 32% Functionality 2.4 | 30 | polymethylene polyphenyl isocyanate (NCO 32%, Functionality 2.7) | 59.95 |
| Tertiary-butyl acetate (TBAC) | 10 | 2,2'-dimorpholinodi-ethylether | 0.1 | polymethylene polyphenyl isocyanate (NCO 32% Functionality 2.4) | 30 | polymethylene polyphenyl isocyanate (NCO 32%, Functionality 2.7) | 59.9 |
| Tertiary-butyl acetate (TBAC) | 10 | 2,2'-dimorpholinodi-ethylether | 0.15 | polymethylene polyphenyl isocyanate (NCO 32% Functionality 2.4) | 30 | polymethylene polyphenyl isocyanate (NCO 32%, Functionality 2.7) | 59.85 |
| Tertiary-butyl acetate (TBAC) | 10 | 2,2'-dimorpholinodi-ethylether | 0.05 | polymethylene polyphenyl isocyanate (NCO 32% Functionality 2.4) | 30 | polymethylene polyphenyl isocyanate (NCO 32%, Functionality 2.7) | 59.95 |
| Tertiary-butyl acetate (TBAC) | 10 | 2,2'-dimorpholinodi-ethylether | 0.1 | polymethylene polyphenyl isocyanate (NCO 32% Functionality 2.4) | 30 | polymethylene polyphenyl isocyanate (NCO 32%, Functionality 2.7) | 59.9 |
| Tertiary-butyl acetate (TBAC) | 10 | 2,2'-dimorpholinodi-ethylether | 0.15 | polymethylene polyphenyl isocyanate (NCO 32%, Functionality 2.4) | 30 | polymethylene polyphenyl isocyanate (NCO 32%, Functionality 2.7) | 59.85 |
| Tertiary-butyl acetate (TBAC) | 20 | 2,2'-dimorpholinodi-ethylether | 0.05 | polymethylene polyphenyl isocyanate (NCO 32%, Functionality 2.4) | 50 | polymethylene polyphenyl isocyanate (NCO 32%, Functionality 2.7) | 29.95 |
| Tertiary-butyl acetate (TBAC) | 20 | 2,2'-dimorpholinodi-ethylether | 0.1 | polymethylene polyphenyl isocyanate (NCO 32%, Functionality 2.4) | 50 | polymethylene polyphenyl isocyanate (NCO 32%, Functionality 2.7) | 29.9 |
| Tertiary-butyl acetate (TBAC) | 20 | 2,2'-dimorpholinodi-ethylether | 0.15 | polymethylene polyphenyl isocyanate (NCO 32%, Functionality 2.4) | 50 | polymethylene polyphenyl isocyanate (NCO 32%, Functionality 2.7) | 29.85 |
| Tertiary-butyl acetate (TBAC) | 20 | 2,2'-dimorpholinodi-ethylether | 0.2 | polymethylene polyphenyl isocyanate (NCO 32%, Functionality 2.4) | 50 | polymethylene polyphenyl isocyanate (NCO 32%, Functionality 2.7) | 29.8 |
| Tertiary-butyl acetate (TBAC) | 10 | dibutyl tin dilaurate | 0.05 | polymethylene polyphenyl isocyanate (NCO 32%, Functionality 2.4) | 30 | polymethylene polyphenyl isocyanate (NCO 32%, Functionality 2.7) | 59.95 |
| Tertiary-butyl acetate (TBAC) | 10 | dibutyl tin dilaurate | 0.1 | polymethylene polyphenyl isocyanate (NCO 32%, Functionality 2.4) | 30 | polymethylene polyphenyl isocyanate (NCO 32%, Functionality 2.7) | 59.9 |
| Tertiary-butyl acetate (TBAC) | 10 | dibutyl tin dilaurate | 0.15 | polymethylene polyphenyl isocyanate (NCO 32%, Functionality 2.4) | 30 | polymethylene polyphenyl isocyanate (NCO 32%, Functionality 2.7) | 59.85 |
| Tertiary-butyl acetate (TBAC) | 10 | dibutyl tin dilaurate | 0.05 | polymethylene polyphenyl isocyanate (NCO 32%, Functionality 2.4) | 30 | polymethylene polyphenyl isocyanate (NCO 32%, Functionality 2.7) | 59.95 |
| Tertiary-butyl acetate (TBAC) | 10 | dibutyl tin dilaurate | 0.1 | polymethylene polyphenyl isocyanate (NCO 32%, Functionality 2.4) | 30 | polymethylene polyphenyl isocyanate (NCO 32%, Functionality 2.7) | 59.9 |
| Tertiary-butyl acetate (TBAC) | 10 | dibutyl tin dilaurate | 0.15 | polymethylene polyphenyl isocyanate (NCO 32%, Functionality 2.4) | 30 | polymethylene polyphenyl isocyanate (NCO 32%, Functionality 2.7) | 59.85 |
| Tertiary-butyl acetate (TBAC) | 20 | dibutyl tin dilaurate | 0.05 | polymethylene polyphenyl isocyanate (NCO 32%, Functionality 2.4) | 50 | polymethylene polyphenyl isocyanate (NCO 32%, Functionality 2.7) | 29.95 |

TABLE 1-continued

| Component and Amount | | | | | | | |
|---|---|---|---|---|---|---|---|
| Solvent | Solvent Wt % | Catalyst | Catalyst Wt % | Isocyanate 1 | Isocyanate 1 Wt % | Isocyanate 2 | Isocyanate 2 Wt % |
| Tertiary-butyl acetate (TBAC) | 20 | dibutyl tin dilaurate | 0.1 | polymethylene polyphenyl isocyanate (NCO 32%, Functionality 2.4) | 50 | polymethylene polyphenyl isocyanate (NCO 32%, Functionality 2.7) | 29.9 |
| Tertiary-butyl acetate (TBAC) | 20 | dibutyl tin dilaurate | 0.15 | polymethylene polyphenyl isocyanate (NCO 32%, Functionality 2.4) | 50 | polymethylene polyphenyl isocyanate (NCO 32%, Functionality 2.7) | 29.85 |
| Tertiary-butyl acetate (TBAC) | 20 | dibutyl tin dilaurate | 0.2 | polymethylene polyphenyl isocyanate (NCO 32%, Functionality 2.4) | 50 | polymethylene polyphenyl isocyanate (NCO 32%, Functionality 2.7) | 29.8 |

The polyurethane sealing material may further comprise a heat stabilizer to prevent degradation of the polyurethane at high temperatures. Heat stabilizers may include inorganic heat stabilizers, halogenated organic heat stabilizers, nitrogen-based heat stabilizers or combinations thereof. In certain preferred embodiments, the polyurethane sealing material may comprise an inorganic heat stabilizer selected from the group comprising aluminum hydroxide, magnesium hydroxide, antimony trioxide, antimony pentoxide, sodium antimonite, zinc borate, zinc stannate, zinc hydrostannate, red phosphorous, ammonium polyphosphate and combinations thereof. In a specific embodiment, the polyurethane sealing material may comprise antimony pentoxide. The polyurethane sealing material may comprise a heat stabilizer in a range of 1-10 wt. %, such as 2-5 wt. % and more specifically 2-3%.

The polyurethane sealing material may also comprise a filler material. This filler material may increase the tensile strength and resistance to abrasive wear of the cured polyurethane sealing material while decreasing the overall cost. In certain embodiments, the polyurethane sealing material may comprise filler materials such as fused silica, carbon black, mica, calcium carbonate, aluminum oxide, zirconium oxide or combinations thereof. In the same or other certain embodiments, the filler material may comprise recycled polyurethane from excess industrial production. In the same or other embodiments, the filler material may comprise a filler made from recycled carpet material. Used carpet materials take up significant space in landfills. Incorporation of recycled carpet materials into the polyurethane sealing material may provide opportunities for acquisition of carbon credits.

Additives may be used to manipulate the viscoelastic properties of the polyurethane mixture in accordance with preferences for specific applications. For example, polyurethane mixtures with lower viscosity values may be preferred in applications with particularly rough surfaces or surfaces with high penetration depth requirements. In contrast, polyurethane mixtures with higher viscosity values may be preferred in applications where the polyurethane sealant should remain on a top-most surface with little to no penetration into the underlying surface. In certain embodiments, the polyurethane mixture may comprise a viscosity between 1 and 1,000 SSU, or more specifically between 1 and 400 SSU, and even more specifically between 1 and 250 SSU, such as 150 SSU at 78° F.

Curing times of the polyurethane mixture may be varied by incorporating various additives into the polyurethane mixture or by varying the composition of the polyurethane, filler, and heat stabilizer combination. Curing time of the urethane may be between 4 and 48 hours, such as between 8 and 48 hours, or between 16 and 48 hours, or more specifically between 20 and 30 hours. In certain embodiments, the curing time of the polyurethane mixture may be increased by reducing the weight percent of the catalyst used in formulation of the liquid polyurethane. Long curing times allow sufficient time for a full work day to be completed with sufficient time remaining to clean and remove polyurethane mixture residue from application equipment such as pumps, containers, or other tools and/or from mixing equipment before the polyurethane mixture cures. In certain specific embodiments, the polyurethane of the present invention comprises between 24 wt. % and 34 wt. % polyurethane with a viscosity between 20 and 100 centipoise at a temperature of 78° F., with a density of 10.1 lbs./gallon.

The polyurethane sealing material may comprise a catalyst to alter the properties of the polyurethane mixture, such as the viscosity, thermal stability, and/or curing time. For example, the polyurethane sealing material may comprise a trimerization catalyst to increase the thermal stability of the cured material. In certain embodiments, the polyurethane sealing material may comprise one or more tertiary amine catalyst and/or one or more organometallic catalyst. Examples of such catalysts include N-methyl morpholine, bismuth carboxylates, triethylenediamine, lead octoate, ferric acetylacetonate, stannous octoate, dimethyltin dilaurate, dibutylin dilaurate, dibutyltin sulfide, which have been found to favorably operate on the MDI urethanes of the present invention. In certain embodiments, the polyurethane sealing material may comprise one or more organometallic catalyst in a range between 0.05 to 0.8 wt. %. In certain specific embodiments, the polyurethane sealing material may be a single-pack, water curing polymeric MDI urethane comprising a 2,2, dimorpholinodiethylether catalyst in about 0.05 to 0.6 wt. %. In certain embodiments, the polyurethane sealing material may comprise one or more tertiary amine catalyst in a range from 0.1 to 0.4 wt. %.

One or more natural polyols (NOP) additives may be included in the polyurethane mixture to decrease the viscosity of the mixture and improve the ability of the mixture to disperse in the grooves of the top surface of the bituminous pathway. Examples of suitable natural oil polyols include polyols derived from soy bean oil, peanut oil, and canola oil. Soy bean oil is a preferred polyol feed stock due to its low environmental impact, availability, and cost. In certain embodiments of the present invention, it has been found that the performance of soy polyol in MDI polyurethane of the present invention is improved by hydroxylating a portion of the soy polyol prior to mixing with MDI polyurethane. Example processes for hydroxylation include ozonolysis, air oxidation, autooxidation, and reaction with peroxy acids followed by reaction with nucleophiles to form hydroxyl groups on the soy polyols. Hydroxylating the soy polyol allows it to react with the MDI polyurethane to provide increase strength and flexibility to the sealed bituminous pathway or reinforced bituminous pavement of the present invention, while the remaining, unreacted soy polyol acts as a plasticizer. In certain embodiments, the polyurethane mixture may comprise 3 to 5 wt. % soy polyols. In other embodiments, the polyurethane mixture may comprise 10 to 30 wt. % hydroxylated soy polyol, such as 15 to 30 wt. %, or more specifically such as 20 to 30 wt. %, or even more specifically such as 25 to 30 wt. % hydroxylated soy polyols.

In certain embodiments, the polyurethane mixture may comprise one or more chain extenders to modify the flexibility and tensile strength of the cured polyurethane sealing material. Chain extenders may be used to speed up the reaction time as desired, for example, in cold environments where the curing time may be depressed due to reduced temperatures. Examples of suitable chain extenders include low molecular weight hydroxyl compounds, such as ethylene glycol and butane diol, and polyolamines such as amine terminated polyether, 2-methyl piperazine, bis(aminomethyl) cyclohexane and isomers, 1,5-diamino-3-methyl-pentane, amino ethyl piperazine ethylene diamine, diethylene triamine, aminoethyl ethanolamine, triethylene tetraamine, isophorone diamine, triethylene pentaamine, ethanol amine, lysine in any of its stereoisomeric forms and salts thereof, hexane diamine, hydrazine and piperazine which react quickly with the isocyanate function groups in the aqueous phase, or combinations thereof.

The color of the polyurethane sealing material may be varied through the use of dyes or pigments or through selection of specific polyurethane starting materials. For example, in certain embodiments, black polyols may be used to form polyurethane giving the resulting cured polyurethane a dark appearance. As discussed above, in general, lighter surface color results in lower absorption of heat across similar materials. The polyurethane material may be configured to be lighter in color for applications in which high heat may be problematic.

Surfactants may be employed in certain embodiments to reduce foaming and increase the density of the cured polyurethane sealing material to improve the long term durability of the bituminous pathway. Suitable foam stabilizing surfactants include sulfates, sulfosuccinamates, and succinamates, and other foam stabilizers known to be useful by those of skill in the art. It has been determined that, in certain embodiments of the present invention, surfactants such as high molecular weight silicone surfactants having an average molecular weight in excess of 9,000 improve the wetting ability of the urethane and increase the surface contact area of the polyurethane to the top surface of the bituminous pathway. Examples of surfactants may be found in U.S. Pat. No. 5,489,617, which is incorporated herein by reference in its entirety. Relevant sections may be found in col. 3-4 of the aforementioned disclosure. Other suitable surfactants that may be employed to advantageously increase the wetting ability of the MDI polyurethane to the bituminous pathway include cationic surfactants, anionic surfactants, zwitterionic surfactants, and non-ionic surfactants. Examples of anionic surfactants include phosphates, carboxylates, and sulfonates. Examples of cationic surfactants include quaternary amines, and example non-ionic surfactants include silicone oils and block copolymers containing ethylene oxide. Suitable surfactants may be either external surfactants, which do not become chemically reacted into the polymer such as dodecyl benzene sulfonic acid and lauryl sulfonic acid salts, as well as internal surfactants such as 2,2-dimethylol propionic acid and its salts, quaternized ammonium salts, and hydrophilic species such as polyethylene oxide polyols.

In certain embodiments, the polyurethane sealing material may comprise one or more plasticizer to improve the wetting ability of the polyurethane mixture to the top layer of the bituminous pathway. In certain embodiments, the polyurethane sealing material may comprise between 1 and 10 wt. % plastizer. Suitable plasticizers include diisodecyl phthalate, di-n-octyl phthalate, diisobutyl phthalate, diisononyl phthalate, bis(2-ethylhexyl)phthalate, diethyl phthalate, and bis(n-butyl)phthalate. It has been found that, in certain embodiments of the present invention, biodegradable plasticizers may be employed to reduce the environmental impact of the material in comparison to embodiments comprising non-biodegradable plasticizers. Suitable biodegradable plasticizers include triethyl citrate, acetyl triethyl citrate, tributyl citrate, acetyl tributyl citrate, trioctyl citrate, acetyl trioctyl citrate, acetyl trihexyl citrate, trimethyl citrate, and alkyl sulphonic acid phenyl ester.

Other additives may be employed to vary the physical properties of the polyurethane mixture and the cured polyurethane sealing material. Examples of other additives may include environmentally friendly solvents to decrease viscosity or the polyurethane mixture, blowing agents, dispersants, cross linkers, light stabilizers such as ultraviolet light absorbers and hindered amine light stabilizers, acid scavengers, antistatic agents and antioxidants.

Methods of Making Paving Systems

As discussed above, polyurethane sealing materials may be used to coat a top surface of a bituminous pathway to create a sealed bituminous pathway or mixed with bituminous rubble to create a slurry which is then allowed to cure to form a reinforced bituminous pavement, or used in combination with reclaimer-stabilizer machines to create a single or multilayer roadway. Several of these techniques may be used alone or in combination to form a roadway. For example, a polyurethane mixture may be spread over the surface by a pouring and smoothing technique. In certain preferred embodiments, a polyurethane mixture may be applied to a top surface of a base layer by spraying the polyurethane mixture using an airless sprayer. The polyurethane mixture may cover an area of the top surface of the bituminous pathway in a range of 50 to 200 square feet per gallon, such as 100 to 150 square feet per gallon. In embodiments in which an asphalt paving system comprises an aperture such as a hole, crack or gap, the polyurethane mixture may be applied over the top surface of the asphalt paving system without the need for filling the aperture with other materials such as standard asphalt concrete repair materials like tar or hot pour bituminous liquid. The polyurethane mixture may be applied such that the polyurethane mixture fills the aperture, or it may simply coat the surface of the aperture.

Conclusion

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatuses. Accordingly, the present embodiments are to be considered as illustrative and not restrictive.

What is claimed is:

1. A method of forming a roadway comprising:
providing a reclaimer-stabilizer machine;
providing in-situ soil materials;
providing a supply of liquid polyurethane;
forming a base layer using the reclaimer-stabilizer machine to pulverize and compact the in-situ soil materials;
forming a wear layer over the base layer using the reclaimer-stabilizer machine, wherein the wear layer is formed by combining the in-situ soil materials with the liquid polyurethane composition; and
allowing the liquid polyurethane to cure.

2. The method of claim 1, wherein the liquid polyurethane comprises an MDI polyurethane.

3. The method of claim 2, wherein the step of forming the base layer further comprises combining the liquid MDI polyurethane with the in-situ soil materials.

4. The method of claim 1, wherein the wear layer further comprises a reinforcing component selected from the group comprising basalt fibers, silica fibers, glass fibers, and polypropylene fibers.

5. The method of claim 1, wherein the base layer further comprises a stabilizing component selected from the group consisting of asphalt, fly ash, and cement.

6. The method of claim 1, wherein the wear layer further comprises a stabilizing component selected from a group consisting of basalt fibers, silica fibers, glass fibers and combinations thereof.

7. The method of claim 1, wherein the liquid polyurethane further comprises a heat stabilizer selected from a group consisting of aluminum hydroxide, magnesium hydroxide, antimony trioxide, antimony pentoxide, sodium antimonite, zinc borate, zinc stannate, zinc hydrostannate, red phosphorous, ammonium polyphosphate and combinations thereof.

8. The method of claim 1, wherein the heat stabilizer is antimony pentoxide.

9. The method claim 7, wherein the liquid polyurethane comprises 2-5 weight percent heat stabilizer.

10. A method of forming a roadway comprising:
providing a reclaimer-stabilizer machine;
providing in-situ soil materials;
providing a supply of liquid polyurethane;
forming a base layer using the reclaimer-stabilizer machine to pulverize and compact the in-situ soil materials;
forming a wear layer over the base layer by spraying the liquid polyurethane on a top surface of the base layer;
allowing the liquid polyurethane to cure.

11. The method of claim 10, wherein the liquid polyurethane covers an area of 50 to 200 square feet per gallon of the liquid polyurethane.

12. The method of claim 10, wherein the step of allowing the polyurethane mixture to cure takes between 8 and 40 hours.

13. The method of claim 10, wherein the polyurethane mixture comprises a viscosity of 20 to 100 centipoise at 78 degrees Fahrenheit.

14. A method of forming a roadway, the method comprising:
providing a cured asphalt concrete composite;
pulverizing the cured asphalt concrete composite into bituminous rubble;
mixing the bituminous rubble with a polyurethane mixture to form a slurry; and
pressing the slurry on a foundation layer; and
allowing the slurry to cure;
wherein the polyurethane mixture comprises:
a liquid polyurethane;
a heat stabilizer; and
a filler material.

15. The method of claim 14, wherein the polyurethane mixture covers an area of 20 to 50 square feet per gallon.

16. The method of claim 14, wherein the polyurethane mixture covers an area of 20 to 30 square feet per gallon.

17. The method of claim 14, wherein the step of allowing the polyurethane mixture to cure takes between 8 and 40 hours.

18. The method of claim 14, wherein the polyurethane mixture comprises a viscosity of 20 to 100 centipoise at 78 degrees Fahrenheit.

19. A method of forming a roadway comprising:
providing a reclaimer-stabilizer machine;
providing in-situ soil materials;
providing a supply of liquid polyurethane;
forming a base layer using the reclaimer-stabilizer machine to pulverize and compact the in-situ soil materials wherein the base layer is formed by combining the in-situ soil materials with the liquid polyurethane composition;
allowing the liquid polyurethane to cure.

20. The method of claim 19, wherein the polyurethane mixture comprises a viscosity of 20 to 100 centipoise at 78 degrees Fahrenheit.

21. The method of claim 19, wherein the polyurethane mixture comprises a viscosity of 20 to 100 centipoise at 78 degrees Fahrenheit.

22. The method of claim 19, wherein the polyurethane mixture comprises a viscosity of 20 to 100 centipoise at 78 degrees Fahrenheit.

23. The method of claim 19, wherein the polyurethane mixture comprises a viscosity of 20 to 100 centipoise at 78 degrees Fahrenheit.

24. The method of claim 19, wherein the polyurethane mixture comprises a viscosity of 20 to 100 centipoise at 78 degrees Fahrenheit.

25. The method of claim 19, wherein the polyurethane mixture comprises a viscosity of 20 to 100 centipoise at 78 degrees Fahrenheit.

* * * * *